US006058984A

United States Patent [19]

Sato

[11] Patent Number: 6,058,984

[45] Date of Patent: May 9, 2000

[54] METHOD FOR FILLING LIQUID INTO LIQUID CONTAINER WITH LIQUID CHAMBER, AND LIQUID FILLING APPARATUS

[75] Inventor: Osamu Sato, Chigasaki, Japan

[73] Assignee: Canon Kabushiki Kaisha, Tokyo, Japan

[21] Appl. No.: 09/124,027

[22] Filed: Jul. 29, 1998

[30] Foreign Application Priority Data

Jul. 30, 1997 [JP] Japan ..... 9-204475

[51] Int. Cl.[7] ..... B41J 2/175

[52] U.S. Cl. ..... 141/7; 141/2; 141/13; 141/18; 141/59; 347/86; 53/432; 53/468

[58] Field of Search ..... 141/2, 4, 5, 7, 141/18, 21, 59, 13; 347/86, 87, 100; 53/432, 468

[56] References Cited

U.S. PATENT DOCUMENTS

| | | | |
|---|---|---|---|
| 4,967,207 | 10/1990 | Ruder | 347/87 |
| 4,968,998 | 11/1990 | Allen | 347/87 |
| 5,509,140 | 4/1996 | Koitabashi et al. | 347/86 |
| 5,663,754 | 9/1997 | Lorenze, Jr. et al. | 347/87 |

FOREIGN PATENT DOCUMENTS

| | | |
|---|---|---|
| 639501 | 2/1995 | European Pat. Off. . |
| 640484 | 3/1995 | European Pat. Off. . |
| 703083 | 3/1996 | European Pat. Off. . |
| 719646 | 7/1996 | European Pat. Off. . |
| 846561 | 6/1998 | European Pat. Off. . |
| 5-338196 | 12/1993 | Japan . |
| 7-68778 | 3/1995 | Japan . |
| 7-125232 | 5/1995 | Japan . |
| 8-90785 | 4/1996 | Japan . |
| 8-132636 | 5/1996 | Japan . |
| 8-230209 | 9/1996 | Japan . |

*Primary Examiner*—J. Casimer Jacyna
*Attorney, Agent, or Firm*—Fitzpatrick, Cella, Harper & Scinto

[57] ABSTRACT

A method of supplying liquid into a liquid container, which includes a first chamber, provided with a liquid supply portion for supplying liquid out, to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the method includes a pressure reducing step of reducing a pressure of an entirety of the container, while the liquid container is hermetically sealed; first liquid supplying step of supplying the liquid into the second chamber, and completing the liquid supply before a portion adjacent to the gas-liquid exchange promoting structure of the negative pressure producing member in the first chamber is supplied with the liquid, in a reduced pressure state provided by the pressure reducing step, with the container taking the same orientation as when the liquid supplied to the liquid ejecting head; a second liquid supplying step of supplying the liquid into the first chamber through the liquid supply portion, after the first liquid supplying step into the second chamber; a releasing step of releasing the hermetically sealed state of the first chamber after the second liquid supplying step into the first chamber.

10 Claims, 15 Drawing Sheets

METHOD FOR FILLING LIQUID INTO LIQUID CONTAINER WITH LIQUID CHAMBER, AND LIQUID FILLING APPARATUS

FIELD OF THE INVENTION AND RELATED ART

The present invention relates to a method for filling liquid into a liquid container, in particularly, a method for filling liquid into an ejection liquid container desirable as a container for holding liquid ink or processing liquid used in an ink jet recording apparatus.

A liquid container or a liquid ejection head cartridge used in a liquid ejecting apparatus, in particular, an ink jet type recording apparatus, has two ports: an ink delivery port through which liquid (ink) is supplied to a recording means such as an ink jet head, and an air vent, through which the atmospheric air is introduced into the container by a volume equivalent to the amount of ink consumption.

This type of ink container is required to be able to stably supply the recording means with ink, without interruption, during a recording period, and also to be able to reliably prevent ink from leaking regardless of ambient conditions, during a non-recording period.

In order to satisfy the above requirements, the inventors of the present invention proposed a liquid container which had a virtually sealed space for holding liquid such as ink, and a negative pressure producing chamber. The negative pressure producing chamber was disposed next to the virtually sealed space, and had a negative pressure producing member. This container is disclosed Japanese Laid-Open Patent Application No. Hei 7-125232, U.S. Pat. No. 5,509,140, Japanese Laid-Open Patent Application No. Hei 7-68778, and the like publications.

As a representative invention of such a type, Japanese Laid-Open Patent Application No. Hei 7-125232 discloses an invention, according to which an ink delivery tube is laterally inserted into the liquid container to create such a pressure distribution pattern, in the negative pressure producing material within the container, that allows the ink within the sealed space to be methodically consumed as the liquid (ink) is replaced by gas (air).

The specification of U.S. Pat. No. 5,509,140 discloses an invention, as a representative invention, according to which an ink container is given an internal structure which enhances gas-liquid exchange so that a region with stable negative pressure can be established within the liquid container at an early stage of ink consumption, through gas-liquid exchange.

Further, Japanese Laid-Open Patent Application No. Hei 7-68778 discloses an invention, according to which an ink container is structured so that ink is delivered through a part of the bottom wall, and the bottom wall is provided with a recessed portion as a temporary ink reservoir. This invention is in accordance with the above-described invention disclosed in the specification of U.S. Pat. No. 5,509,140.

Japanese Laid-Open Patent Application Hei 7-125232 discloses an ink container which comprises two chambers. One chamber is a negative pressure producing material holding chamber, which is provided with an air vent, and holds negative pressure producing material. The other chamber is a liquid holding chamber, which is connected to the negative pressure producing material holding chamber, and holds nothing but the ink. This ink is delivered to the negative pressure producing material through a minute passage only, which is disposed between the two chambers, away from the air vent. According to this invention, the ink container is stabilized in terms of negative pressure, so that ink delivery efficiency is improved.

A method for filling an ink container (ink cartridge) with the above described structure is disclosed in Japanese Laid-Open Patent Application No. Hei 8-090785. According to this application, while ink is filled into an ink container, the ink container is held in a slanted position, and ink is filled into the container, carefully timing the opening or shutting of the ink delivery opening and the air vent. Another ink filling method is disclosed in Japanese Laid-Open Patent Application No. Hei 8-132636, according to which ink is filled into an ink container by reducing the internal pressure of the ink container.

The above described ink filling methods for filling an ink container with ink are quite rational from the standpoint of reliably filling ink into an ink container, or an ink jet cartridge comprising an ink container and a recording head, while preventing ink from leaking.

However, as usage of ink jet type recording apparatuses has spread widely and rapidly in recent years, demands for faster printing, and prints with high quality have also increased. Faster printing, and high quality prints, require ink container exchange frequency to be reduced, and in order to reduce ink container exchange frequency, an ink container with a large capacity is desired. From the standpoint of size reduction of a recording apparatus, a large capacity ink container is desired to have such a structure that liquid is delivered to a recording head through a part of the bottom wall of the ink container.

Further, such ink containers with a large ink capacity, and ink cartridges comprising such an ink container, are desired to e as inexpensive as possible in a consumer market. Therefore, a less expensive and more efficient method for filling ink into an ink container during ink container manufacturing has been sought after.

Thus, the inventors of the present invention studied liquid containers, which comprised a liquid holding chamber, and a negative pressure producing chamber. The liquid holding chamber was virtually sealed, and exclusively held liquid, and the negative pressure producing chamber contained a piece of negative pressure producing material, or a negative pressure producing member. The inventors of the present invention also studied liquid filling methods, which were supposed to be capable of filling liquid into the above described liquid containers at a high speed even if the size of the negative pressure producing chamber, which contained the negative pressure producing material, was increased by extending the chamber in the direction parallel to the bottom wall, and at the same time, the overall space surrounded by the external walls of the liquid container was also increased.

The studies revealed that if conventional liquid filling methods are used to fill liquid into the large capacity container which delivers liquid to a head from a part of the bottom wall of the liquid container, there sometimes will be problems in filling the liquid containers.

For example, in the case of the ink filling method disclosed in Japanese Laid-Open Patent Application No. Hei 8-090785, the timing with which the air vent and the ink delivery port are opened or closed, and the angle of an ink container, must be changed according to the amount of the ink having been filled into the container. Therefore, an ink filling apparatus in accordance with this ink filling method becomes too complicated, and also, it is possible that manufacturing related nonuniformity may increase due to variation in the time necessary to switch manufacturing steps.

In the case of the ink filling method disclosed in Japanese Laid-Open Patent Application No. Hei 8-132636, the internal pressure of an ink container is first reduced, and then, ink is filled from the porous material side. In other words, in the case of this liquid filling method, ink is filled through a large piece of porous material. Therefore, ink sometimes suddenly enters an ink chamber before the porous material is completely filled with ink. This creates a problem in that a substantial portion of the ink chamber may not be filled with ink. If a substantial portion of an ink chamber is not filled with ink, the ink container becomes very sensitive to the pressure of the ambience in which the ink container, having been sealed for shipment, is unsealed to be used for the first time or the like occasion; in other words, ink may leak, or air may enter the ink container through the ink delivery opening for delivering ink outward, and consequently, the liquid may be prevented from being stably delivered.

Further, in the case of the ink filling method disclosed in Japanese Laid-Open Patent Application No. Hei-8-230209, as liquid is rapidly filled into a liquid container structured to be filled with liquid through a part of its bottom wall, the negative pressure producing member is nonuniformly filled with ink. This nonuniform ink distribution in the negative pressure producing material is caused because the liquid is filled into the negative pressure producing material chamber through a passage which connects the negative pressure producing material chamber and the liquid chamber. With ink being nonuniformly distributed in the negative pressure producing material, it is possible for air to be introduced into a recording head through the air vent before the liquid in the liquid chamber is consumed for recording. As a result, ink delivery is liable to be interrupted.

SUMMARY OF THE INVENTION

An object of the present invention is to provide a highly productive ink filling method and a highly productive ink filling apparatus, which can assure that a liquid container structured to deliver liquid to a head through a part of its bottom wall is prevented from being nonuniformly filled with liquid, even if the container is large.

Another object of the present invention is to provide a liquid filling method which is capable of making full use of the advantageous characteristics of the aforementioned ink container to stably deliver the liquid when the ink container is in use.

According to an aspect of the present invention, there is provided method of supplying liquid into a liquid container, which includes a first chamber, provided with a liquid supply portion for supplying liquid out, to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the method comprising: a pressure reducing step of reducing a pressure of an entirety of the container, while the liquid container is hermetically sealed; first liquid supplying step of supplying the liquid into the second chamber, and completing the liquid supply before a portion adjacent to the gas-liquid exchange promoting structure of the negative pressure producing member in the first chamber is supplied with the liquid, in a reduced pressure state provided by the pressure reducing step, with the container taking the same orientation as when the liquid supplied to the liquid ejecting head; a second liquid supplying step of supplying the liquid into the first chamber through the liquid supply portion, after the first liquid supplying step into the second chamber; a releasing step of releasing the hermetically sealed state of the first chamber after the second liquid supplying step into the first chamber.

According to anther aspect of the present invention, there is provided a method of supplying liquid into a liquid container, which includes a first chamber, provided with a liquid supply portion for supplying liquid out, to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the method comprising: a pressure reducing step of reducing a pressure of an entirety of the container, while the liquid container is hermetically sealed; first liquid supplying step of supplying the liquid into the second chamber, and completing the liquid supply before a portion adjacent to the gas-liquid exchange promoting structure of the negative pressure producing member in the first chamber is supplied with the liquid, in a reduced pressure state provided by the pressure reducing step, with the container taking the same orientation as when the liquid supplied to the liquid ejecting head; a second liquid supplying step of supplying the liquid into the first chamber through the liquid supply portion, after the first liquid supplying step into the second chamber; a liquid discharging step of discharging a predetermined quantity of the liquid from the first chamber through the liquid supply portion after the second liquid supplying step.

The liquid filling method in accordance with the present invention means such a liquid filling method that can be used for not only filling a liquid container during a liquid container manufacturing step, but also desirably refilling an ink container after it is completely or partially depleted of the liquid. In other words, it is a liquid filling method usable for initially filling a liquid container, as well as refilling the liquid container after the liquid container is put to use.

According to the aforementioned ink filling method based on the present invention, the second chamber can be rapidly and reliably filled with liquid. Further, the negative pressure producing member is evenly filled with liquid, without leaving any region of the negative pressure producing member unwetted, by filling liquid into the first chamber through the liquid delivery portion of the first chamber. In other words, the present invention can provide a highly productive precise liquid filling method.

Further, after the first chamber is completely filled with liquid, the liquid in the first chamber is discharged by a predetermined amount from the liquid delivery port, to assure that a region, which has a desirable degree of absorbency for enabling the liquid container to properly react to changes in ambience or the like, is created adjacent to the air vent, in the negative pressure producing material.

This liquid filling method can provide high precision and high efficiency in liquid filling, on its own. However, this liquid filling methods is desirable to be used in combination with the following processes, because such a combination can enhance the merits of this method.

1. To take a liquid container out of a sealed state just before the first chamber is completely filled with liquid. This process can prevent gas (air) from being rapidly introduced into the liquid chamber; gas (air) is prevented from unexpectedly entering the liquid chamber.

2. To fill liquid into the adjacencies of the communication port, through the liquid delivery port or the first chamber, before starting to fill the second chamber with liquid. This process assures that the portion of the negative pressure producing member, which becomes the ink flow route when a liquid container is use, is properly filled for stably delivering liquid even if the liquid container in use has the aforementioned structure and also is large.

These processes are effective individually to enhance productivity, but they can further enhance the objects of the present invention when used in combination.

The liquid ejecting method in accordance with the present invention is particularly suitable for liquid containers which have a second chamber with an internal volume of 10 cc or graster, although it is also compatible with liquid containers which have a second chamber with an internal volume of less than 10 cc.

According to a further aspect of the present invention, there is provided an apparatus for supplying liquid into a liquid container, which includes a first chamber, provided with a liquid supply portion for supplying liquid out, to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the apparatus comprising: sealing means for sealing the liquid container; pressure reducing means for reducing a pressure of an entirety of the container, while the liquid container is hermetically sealed; first liquid supplying means for supplying the liquid into the second chamber, and completing the liquid supply before a portion adjacent to the gas-liquid exchange promoting structure of the negative pressure producing member in the first chamber is supplied with the liquid, in a reduced pressure state provided by the pressure reducing step, with the container taking the same orientation as when the liquid supplied to the liquid ejecting head; second liquid supplying means for supplying the liquid into the first chamber through the liquid supply portion, after the first liquid supplying step into the second chamber; releasing means for releasing the hermetically sealed state of the first chamber after the second liquid supplying step into the first chamber.

According to this aspect of the present invention, it is possible to provide a liquid filling apparatus, with which the aforementioned liquid filling method can be desirably carried out.

In this specification of the present invention, a "top portion" means the portion which directly faces the bottom wall of a liquid container. When the top portion is on the top, the communication port is at the bottom.

An expression, "region which is located adjacent to the top portion of the first chamber, and is not filled with liquid (ink)" is used as a sentence that means not only an empty space (air buffer chamber), that is, a space without the negative pressure producing material, but also a region which is filled with the negative pressure producing material, but is not filled with liquid (ink).

The expressions, "negative pressure producing material holding chamber" and "ink holding chamber", are applied to only such a chamber that meets requirements for holding or storing ink (liquid), whereas the expressions, "first chamber" and "second chamber", are more loosely used to refer to the chambers; not only are they applied to a chamber which meets the requirements for holding and storing ink (liquid), but also a chamber which is in a process of satisfying the requirements.

The structure, in accordance with the present invention, for enhancing gas-liquid exchange includes any structure that can introduce the atmospheric air into a liquid chamber to allow the liquid in the virtually sealed liquid chamber to be supplied to a negative pressure producing material chamber, without substantially changing the negative pressure (correspondent to liquid level) produced by the negative pressure producing material; for example, the atmospheric air introduction path described in the specification of the present invention, an atmospheric air priority path formed by differentiating the pore size in a predetermined region of the negative pressure producing material from the pore size in the other region, an atmospheric air introduction path constituted of a piece of tube, or an atmospheric air introduction path constituted of the minute gap formed between the absorbent material and the wall.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

First, referring to FIGS. 1 and 2, the configuration of a liquid container compatible with the liquid filling method in accordance with the present invention will be described.

Figure 1:
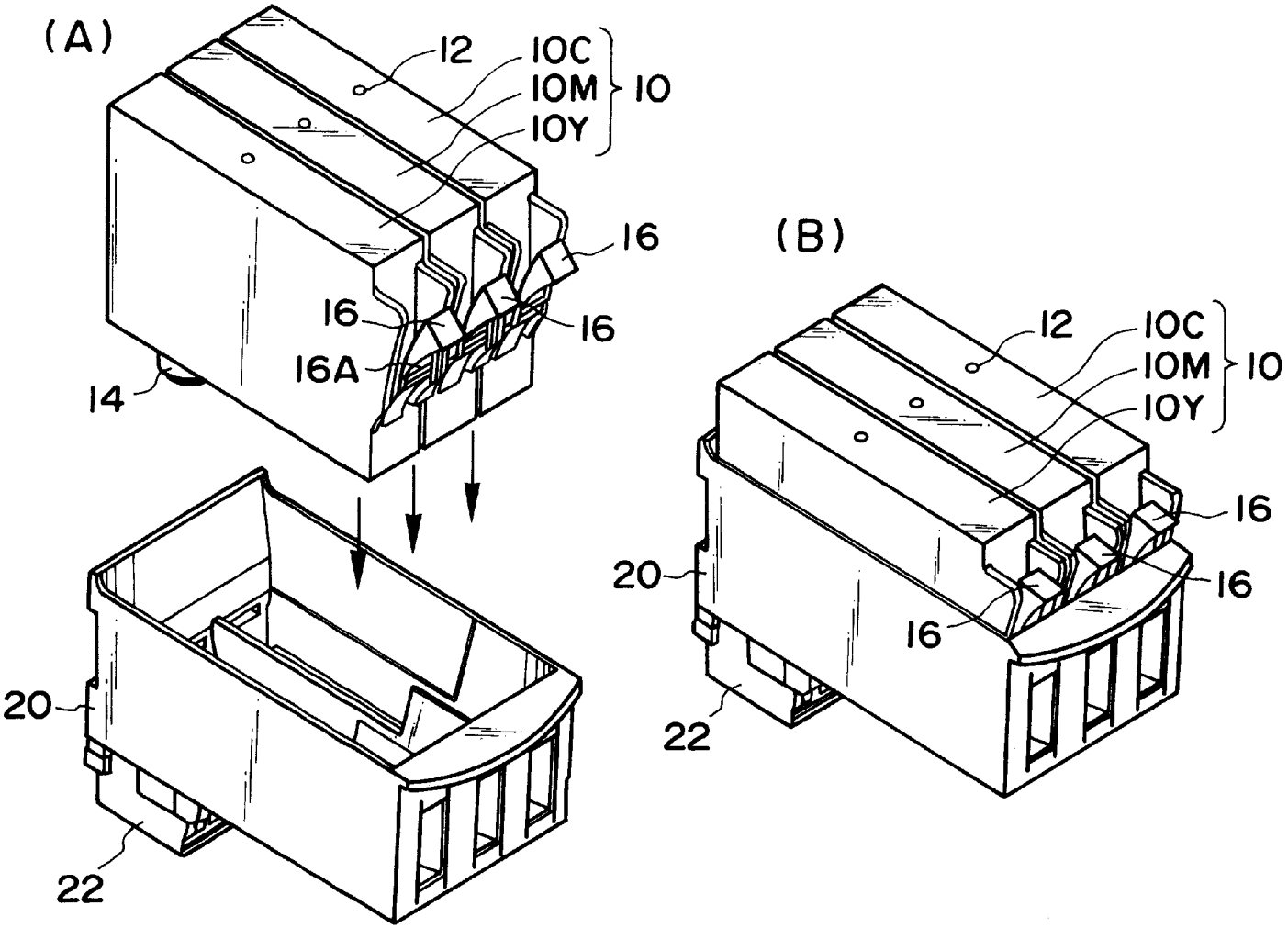
FIG. 1 is a schematic perspective view of an ink container compatible with the liquid filling method in an embodiment of the present invention, (A) and (B) presenting the ink container before and after the installation of the ink container, respectively.

FIG. 1 is a schematic perspective view of an ink container compatible with the liquid filling method in accordance with the present invention, and an ink container holder in which the ink container is removably installable. FIG. 1, (A, B) present their states before and after the installation of the container into the holder.

An ink container 10 as a container for liquid to be ejected is approximately in the form of a parallelepiped. The top wall 10U of the container 10 is provided with an air vent, that is, a hole that leads to the internal space of the container 10.

The ink container 10 is also provided with an ink delivery port 14, which is in the form of a cylinder. The ink delivery port 14 projects from the bottom wall 10B of the ink container 10, and has an ink delivery opening, that is, an opening through which the liquid is delivered outward when the ink container 10 is in use. During shipment, the air vent 12 is kept sealed with a sheet of film or the like, and the cylindrical ink delivery port 14 is kept sealed with a cap as an ink delivery opening sealing member.

Figure 16:
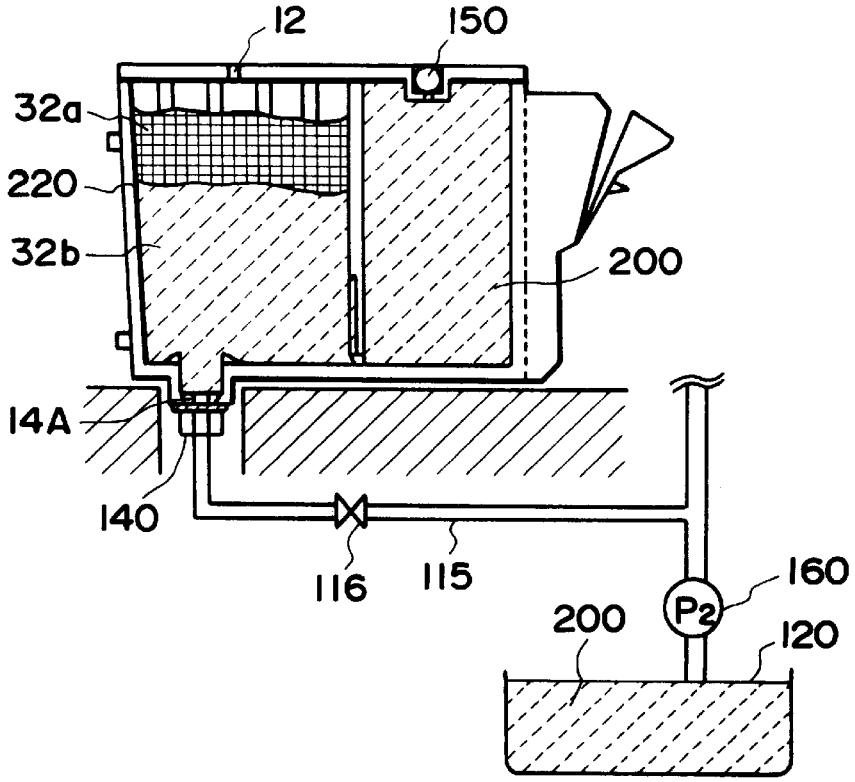
FIG. 16 is a sectional drawing which depicts a liquid filling apparatus, and a liquid filling method, in accordance with the present invention.

A referential FIG. 16 designates a flexible lever, which is integrally formed with the ink container 10. It has a latching projection, which projects from the center portion of the lever.

A referential FIG. 20 designates an ink container holder into which the ink container 10 is installed. It is integrally formed with a head. In this embodiment, the ink container holder 20 holds, for example, an ink container 10C for cyan C ink, an ink container 10M for magenta M ink, and an ink container 10Y for yellow Y ink. The bottom portion of the ink container holder 20 is provided with a color ink jet head 22, which is integral with the holder 20. The color ink jet head 22 has a plurality of ejection outlets, which face downward (hereinafter, the head surface at which these ejection outlets open will be referred to as an ejection outlet opening surface).

The ink container 10 is inserted into the ink container holder 20 integral with the color ink jet head 22, while being held as depicted in FIG. 1, (A), so that the cylindrical ink delivery port 14 engages with the unillustrated ink receiving portion of the color ink jet head 22, and the cylindrical ink receiving port of the color ink jet head 22 enters the cylindrical ink delivery port 14. Then, the latching projection 16A of the lever 16 engages with an unillustrated projection located at a predetermined point of the ink container holder 20 integral with the head 22. Consequently, the ink container 10 is correctly held by the ink container holder 20 as depicted in FIG. 1, (B). After the ink container 10 is installed into the ink container holder 20 integral with the head 22, the ink container holder 20 is mounted onto the carriage of an unillustrated ink jet type recording apparatus, to be prepared for printing. As the ink container holder 20 which is holding the ink container 10 is mounted onto the carriage, a predetermined amount of head difference H is created between the bottom portion of the ink container 10 and the ejection outlet opening surface of the ink ejecting head.

At this time, the internal structure of the ink container 10, which is common to all the embodiments of the present invention, will be described with reference to FIG. 2.

The internal space of the ink container 10 in this embodiment comprises two chambers separated by a partition wall 38; a negative pressure producing member chamber 34 (first chamber), and a liquid chamber 36 (second chamber). The negative pressure producing member chamber 34 holds an absorbent member 32 as a negative pressure producing member. The top wall of the negative pressure producing member chamber 34 has an air vent 12, through which the internal space of the negative pressure producing member chamber 34 is connected to the atmosphere, and the bottom wall of the negative pressure producing member chamber 34 has an ink delivery opening. The ink chamber 36 is virtually sealed, and holds liquid ink alone. The first chamber 34 and the second chamber 36 are connected to each other only through a communication port 40 cut through the bottom portion of the partition wall 38.

The inward surface of the top wall 10U of the first chamber 34 is provided with a plurality of ribs 42, which are integrally formed with the wall 10U, and project straight inward. As the absorbent member 32 is compressed into the first chamber 34, it comes in contact with the plurality of the ribs 42, leaving a space, as an air baffler chamber 44, between the top wall 10U and the top surface of the absorbent member 32. The absorbent member 32 is formed of thermal compression urethane foam, and is held compressed in the first chamber to produce a predetermined amount of capillary force as will be described later. The absolute value of the pore density of the absorbent member 32 for producing the predetermined amount of capillary force is varied depending on the type of the ink to be used, the measurement of the ink container 10, the vertical position (head difference H) of the ejection outlet opening surface of the ink jet head 22, and the like. However, the density needs to be at least approximately 50 pores per inch, because the absorbent member 32 is required to produce a capillary force greater than the capillary force produced by the capillary force producing groove, or a path, as a capillary force producing portion, which will be described later.

In the cylindrical ink delivery port 14, which has an ink delivery opening 14A, a contact member 46 in the form of a disc or a circular column is disposed. The contact member 46 is formed of propylene felt, and is not easily deformable by external force. The contact member 46 is inserted into the cylindrical ink delivery port 14 in such a manner that when the ink container 10 has not been inserted into the ink container holder 20, the absorbent member 32 remains locally compressed by the contact member 46 as shown in FIG. 2. In order to keep the contact member 46 in the state described above, the outer edge of the cylindrical ink delivery port 14 is provided with a flange, which comes in contact with the contact member 46 as the contact member 46 is inserted into the cylindrical ink delivery port 14.

It is desirable that the depth of the depression which the contact member 46 makes in the absorbent member 32 after the cylindrical ink receiving port of the aforementioned color ink jet head 22 is inserted into the cylindrical ink delivery port 14 is in a range of 1.03–3.0 mm, whereas the depth of the depression which the contact member 46 makes in the absorbent member 32 when the cylindrical ink receiving port of the head 22 is out of the cylindrical ink delivery port 14 is in range of 0.5–2.0 mm. This prevents ink from dripping after the ink container 10 is removed from the head 22, and also assures that ink desirably flows when the ink container 10 is in use.

Since the contact member 46 is disposed adjacent to the ink delivery portion, being pressed into the absorbent member 32, the portion of the absorbent member 32 which is in contact with the contact member 46 deforms. Therefore, if the ink delivery opening 14A is extremely close to a communication port 40, that is, a port through which gas-liquid exchange occurs, the deformation of the absorbent member 32 affects the gas-liquid exchange port, which causes the amount of ink filled into each container during the manufacturing process to be nonuniform. In the worst case, a proper amount of negative pressure may not be produced, and as a result, ink may drip from the ink delivery opening 14A. On the other hand, if the ink delivery opening 14A is far away from the communication port 40, that is, the port through which gas-liquid exchange occurs, the flow resistance from the communication port 40 to the ink delivery opening 14A increases during the gas-liquid exchange operation, which will be described later, and as a result, ink delivery pressure may be lost, and consequently, the ink delivery may be interrupted if ink consumption speed happens to be high. Thus, the distance between the communication port 40 and the ink delivery opening 14A is desired to be in a range of 10–50 mm.

Next, the relationship between the negative pressure producing member holding chamber 34 and the liquid holding chamber 36 will be described. When the ink container 10 is in use, that is, when there is air in the top portion of the liquid holding chamber 36, the air expands as it is exposed to ambient temperature or pressure change. As a result, ink is sometimes forced out into the negative pressure producing holding chamber 34. This ink is absorbed by the absorbent member 32 in the negative pressure producing holding chamber 34. Therefore, the volume of the absorbent member 32 should be set in consideration of every predictable condition under which the ink container 10 may be used; in other words, the absorbent member 32 should be rendered large enough to enable the absorbent member 32 to satisfactorily absorb even the largest amount of the ink which is possible to be formed out of the ink holding chamber 36 by the ambient temperature or pressure change.

However, the actual liquid absorbing ability of the absorbent member 32 is not determined simply by the volume of the absorbent member 32, because the ink, which is forced out of the ink holding chamber 36, must be absorbed upward by the absorbent member 32 against gravity. Therefore, the ink may leak from the ink delivery opening even when the volume of the absorbent member 32 is large enough. For example, in the case of a large capacity ink container, the height of the absorbent member 32 is great (for example, it may be greater than 40 mm), and therefore, the ink forced out of the ink holding chamber 36 must be absorbed higher, that is, the ink level (gas-liquid interface) within the absorbent member 32 must be raised to a higher level. In this situation, the speed at which the absorbent member 32 absorbs the ink, that is, the speed at which the absorbent member 32 raises the liquid level in itself, may not be fast enough to deal with the amount of the ink being forced out of the ink holding chamber 36. This problem, which is related to the speed at which the liquid level in the absorbent member 32 is raised, can be solved by changing the configuration of the absorbent member 32; it is desirable that size of the bottom wall of the negative pressure producing holding chamber 34 is increased.

However, if the size of the bottom wall of the negative pressure producing member holding chamber 34 is increased, the volume of the negative pressure producing member holding chamber 34 also increases, which in turn reduces the volume of the ink holding chamber 36, because the overall volume available for the ink container 10 is limited. As a result, the amount of ink holdable in the ink container 10 is reduced.

On the other hand, the ink absorbing speed of the absorbent member 32 is also affected by the surface tension of the ink. Therefore, when optimizing the ratio in volume between the negative pressure producing member holding chamber 34 and the ink holding chamber 36, the surface tension of the liquid to be held must be taken into consideration. For example, when an attempt was made to optimize the volume ratio between the negative pressure producing member holding chamber 34 and the ink holding chamber 36 while varying the surface tension $\tau$ of the liquid to be held in a range of 30–50 dyn/cm, and also assuming that the normal temperature at which the ink container 10 is used was in a range of 5–35 deg., the optimum ratio fell in an approximate range of 1:1–5:3.

As for the size of the air buffer chamber 44 in the negative pressure producing member holding chamber 34, it is desired to be rendered as small as possible from the standpoint of volumetric efficiency. However, it is necessary to assure that the air buffer chamber 44 has a large enough volume to prevent ink from spewing out of the air vent 12 when ink suddenly flows into the negative pressure producing member holding chamber 34. For this reason, it is desirable that the volume of the air buffer chamber 44 is set at approximately ⅕–⅛ of the volume of the negative pressure producing member holding chamber 34.

Next, the structure for controlling the negative pressure, which the absorbent member 32 as the negative pressure producing member produces, will be described.

Figure 6:
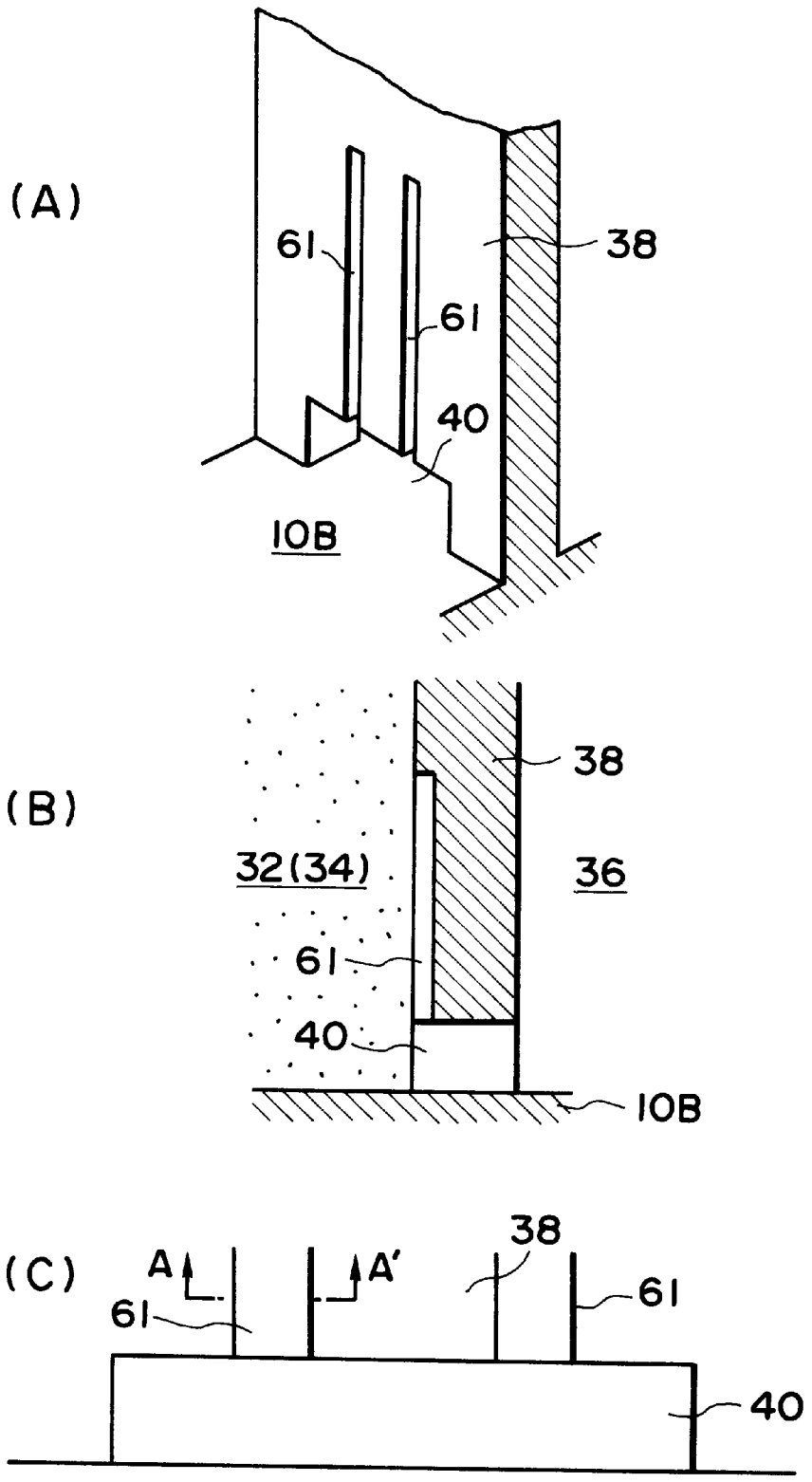
FIG. 6, (A, B and C), are schematic perspective views of the partition wall of an ink container compatible with the liquid filling method in another embodiment of the present invention, a schematic section of the same, and a front view of the same, respectively.

Referring to FIG. 6, in the first embodiment, the bottom portion of the negative pressure producing material holding chamber side of the partition wall 38 is provided with two parallel paths (grooves) 61 which constitute the capillary force generating portion of the atmospheric air introduction path. The grooves 61 extend along the lateral surface of the absorbent member 32 as the negative pressure producing material, and their bottom ends are connected to the communication port 40. As will be described later, the grooves 61, which constitute the capillary force generating portion, are thought to form such capillary tubes that generate capillary force between the surfaces of the grooves 61 cut in the partition wall 38 and the lateral surface of the absorbent member 32.

Figure 7:
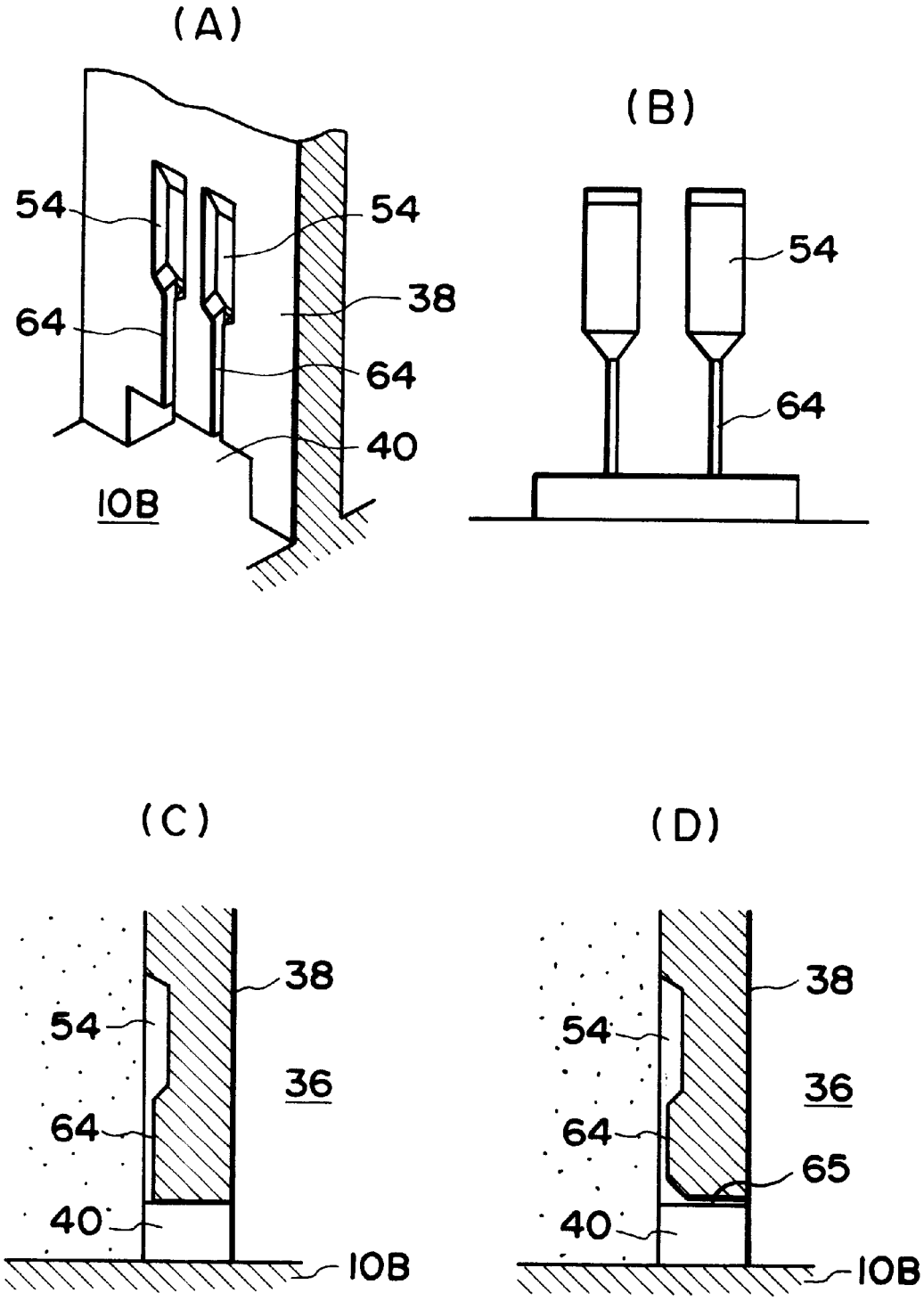
FIG. 7, (A, B, C and D), are schematic perspective views of the partition wall of an ink container compatible with the liquid filling method in another embodiment of the present invention, a schematic section of the same, and a front view of the same, and a schematic section of the partition wall of an ink container compatible with the liquid filling method in another embodiment of the present invention, respectively.

Referring to FIG. 7, in the second embodiment, the bottom portion of the negative pressure producing material holding chamber side of the partition wall 38 is provided with two parallel first parts (grooves) 54 as the atmospheric air introduction paths, and two parallel second paths (grooves) 55. The grooves 54 extend along the lateral surface of the absorbent member 32 as the negative pressure producing material, and their bottom ends are connected one for one to the top ends of the grooves 64, which also extend along the lateral surface of the absorbent member 32, and the bottom ends of which are connected to the communication port 40. These grooves 54 and 64, and the lateral surface of the absorbent member 32, form the atmospheric air introduction paths. A portion of the path 64 constitutes the capillary force generating portion. Referring to FIG. 7, (D), the bottom end portions of the second paths 64, which constitute the capillary force generating portion, may be connected, one for one, to parallel grooves 65 cut in the top surface of the communication port 40 in the longitudinal direction of the communication port 40. With the provision of the grooves 65, it is assured that even if the absorbent member 32 is forced into the bottom end portion of the second grooves 64, the atmospheric air introduction path is not blocked. Further, according to this embodiment, the partition wall 38 is provided with the first grooves 54 which are larger than the second grooves 64, and therefore, it is assured that a sufficient amount of the atmospheric air is introduced, reducing thereby the force that impedes the initiation of gas-liquid exchange. As will be described later, the second paths 64 are also thought to form such capillary tubes that generate capillary force between the surfaces of the grooves 61 cut in the partition wall 38 and the lateral surface of the absorbent member 32. In the case of a modification of this embodiment depicted in FIG. 7, (D), the bottom edge of the second grooves 64 are tapered to make it easier for air to pass.

Figure 3:
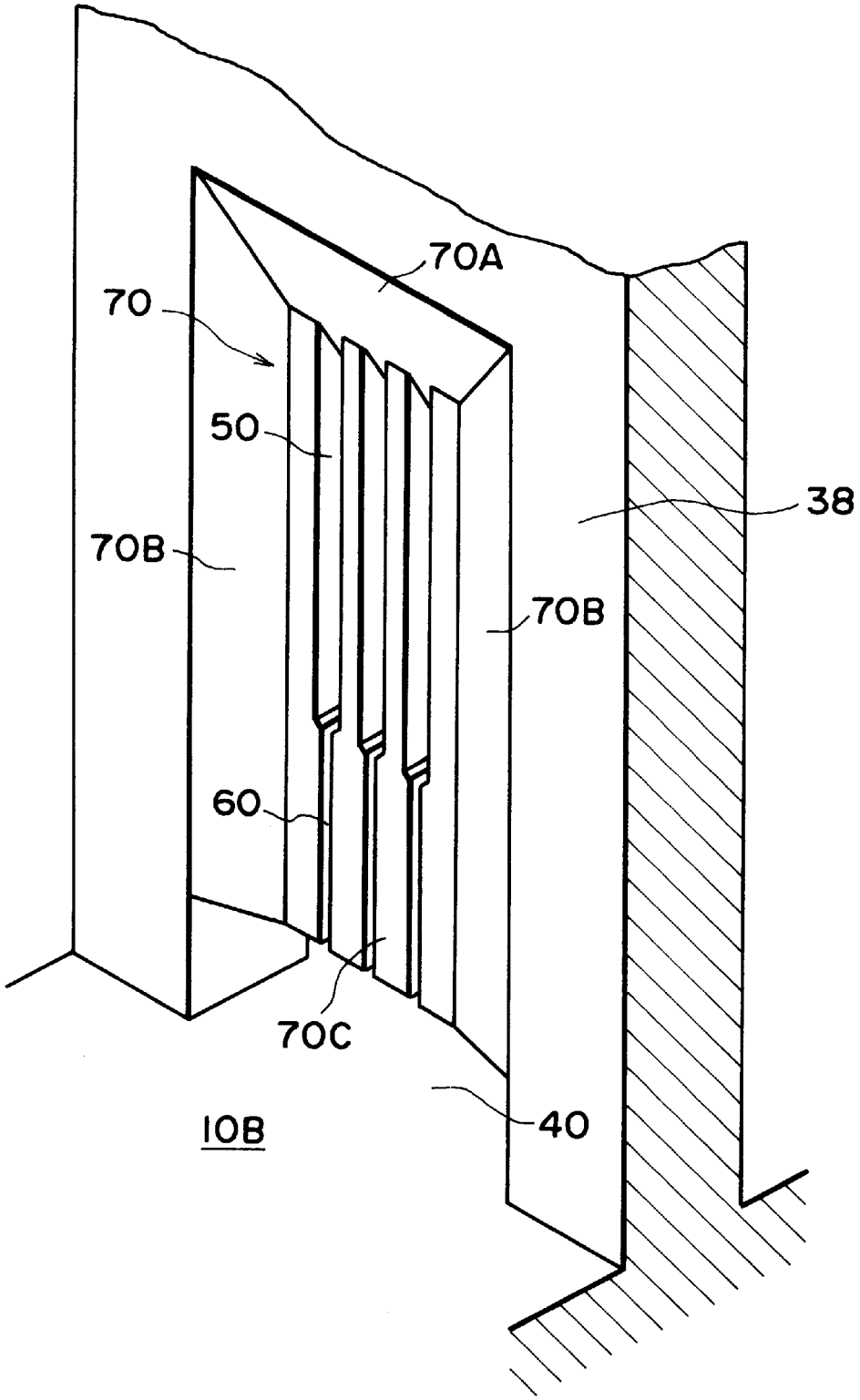
FIG. 3 is a perspective view of the essential portion of the ink container depicted in FIG. 2.

In the case of the third embodiment, the bottom portion of the negative pressure producing material chamber side of the partition wall 38 is provided with three pairs of a first groove 50 and a second groove 60, as shown in enlargement in FIG. 3. The groove 50 extends along the lateral surface of the absorbent member 32 as the negative pressure producing material, and constitutes a part of the atmospheric air introduction path, together with the lateral surface of the absorbent member 32, and the groove 60 also extends along the lateral surface of the absorbent member 32, and constitutes another portion of the atmospheric air introduction path. The bottom end of the groove 50 is connected to the top end of the groove 60, and the bottom end of the groove 60 is connected to the communication port 40.

In the third embodiment, the first grooves 50 and the second grooves 60, which constitute a capillary force generating portion, are cut in the bottom surface of a recess 70 of the partition wall 38. More specifically, the recess 70 is cut in the negative pressure producing material chamber facing surface of the bottom end portion of the partition wall 38, being centered in terms of the width direction of the partition wall 38, and has three lateral surfaces 70A, 70B, and 70B, which are gently slanted relative to the surface of the partition wall 38 toward the center of the recess 70, and a bottom surface 70C, which is parallel to the surface of the partition wall 38. The width of the communication port 40 is rendered substantially equal to the width of this recess 70. With the provision of the above structure, the absorbent member 32 placed in the negative pressure producing member holding member 34 is pressed against five surfaces: the surface of the partition wall 38, the three lateral surfaces 70A, 70B, and 70B of the recess 70, and the bottom surface 70C of the recess 70. As a result, three capillary tubes which generate capillary force are formed by the three grooves 60 in the partition wall 38 and the lateral wall of the absorbent member 32. Placing the first grooves (paths) 50 and the second grooves (paths) 60 at the bottom surface of the recess 70 as they are in this embodiment assures that the atmospheric air is more stably introduced, and gas-liquid exchange becomes more stable, compared to the structures in the preceding embodiments. It is also effective to prevent air bubbles from collecting at the communication port 40.

Figure 4:
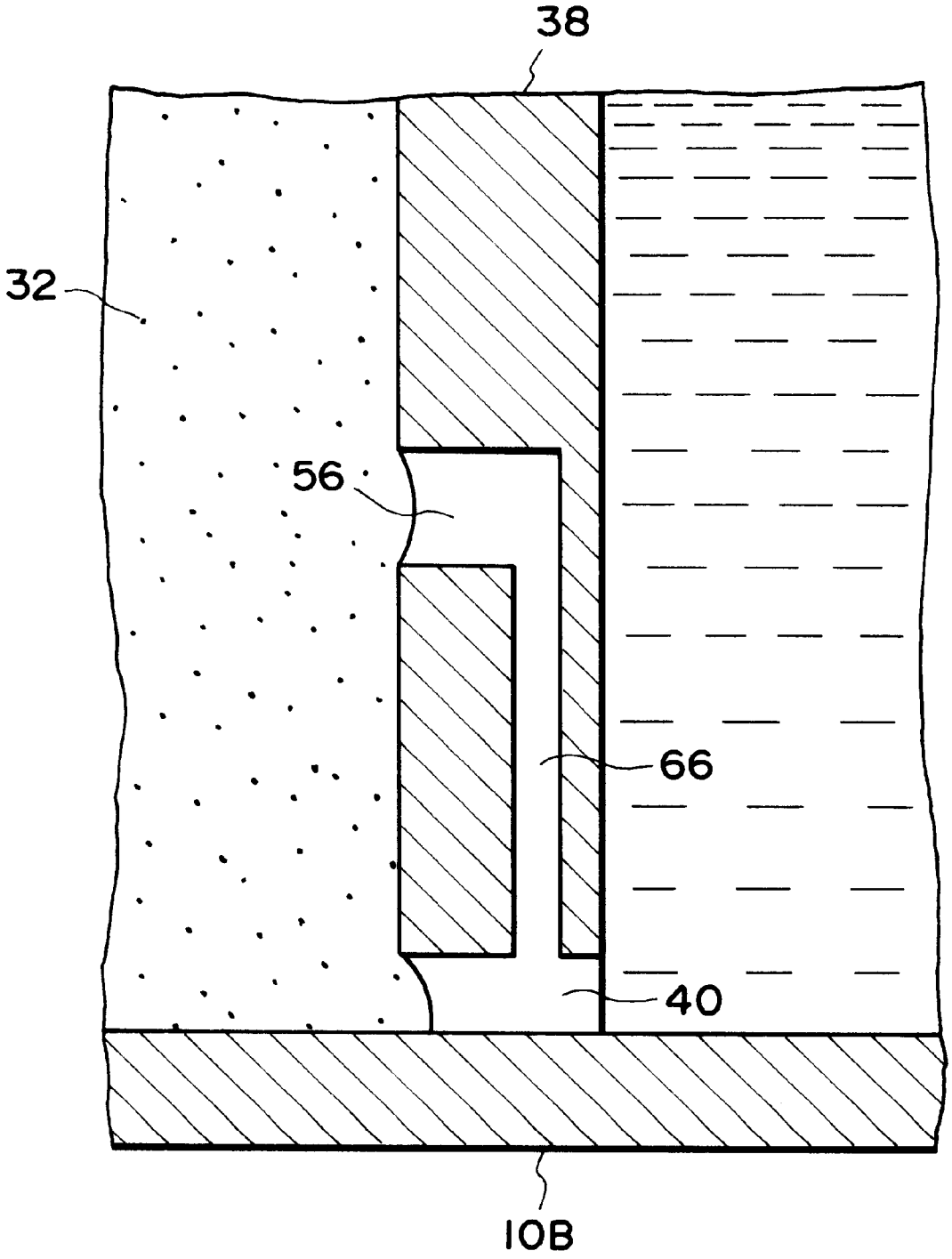
FIG. 4 is a section of the essential portion of the configuration of an ink container compatible with the liquid filling method in another embodiment of the present invention.

In the preceding embodiments, the atmospheric air introduction paths are formed by cutting the first and second grooves in the surface of the partition wall 38. However, the atmospheric air introduction path may be directly cut through the partition wall 38 as shown in FIG. 4. In other words, an atmospheric air introduction path 56 as the first path, the opening side of which makes contact with the absorbent member 32 as the negative pressure producing material, and a capillary force generating path 66, as the second path, the internal end of which is connected to the internal end of the path 56, and the opening side, at the bottom end, of which is connected to the communication port 40, may be formed in the bottom portion of the partition wall 38. With this arrangement, the capillary force generating path 66 is enabled to generate capillary force without being affected by the absorbent member 32, because it is not formed by covering the portions of the groove with the absorbent member 32 as it is in the cases of the preceding embodiments.

At this time, before describing the operational principles of the ink containers in the embodiments of the present invention, the definitions of the terms used in the following description of the embodiments of the present invention will be clarified with reference to FIGS. 8–10.

Figure 8:
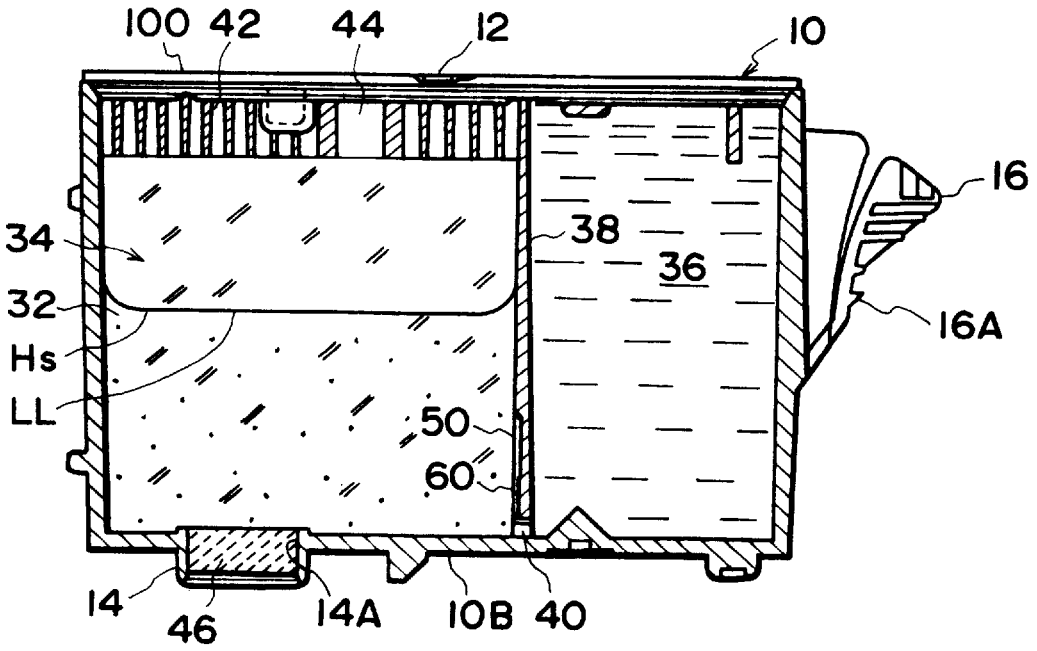
FIG. 8 is a section of an ink container compatible with the liquid filling method in another embodiment of the present invention, and depicts the capillary force Hs of the absorbent material.

FIG. 8 depicts a state of the ink container 10, in which the liquid chamber 36 is being filled with ink; ink has been absorbed upward into the absorbent member 32 by the capillary force of the absorbent member 32, and the gas-liquid interface LL has risen to the level indicated in the drawing. In the drawing, the capillary force Hs of the absorbent member 32, that is, the capillary force of the absorbent member 32 expressed in terms of length by dividing the capillary force of the absorbent member by the product of the ink density ρ and the gravitational acceleration g, is measured as the vertical distance between the position of the gas-liquid interface LL before the beginning of gas-liquid exchange, and the position of the head of the liquid in a liquid tube extending from the gas-liquid interface LL.

Figure 9:
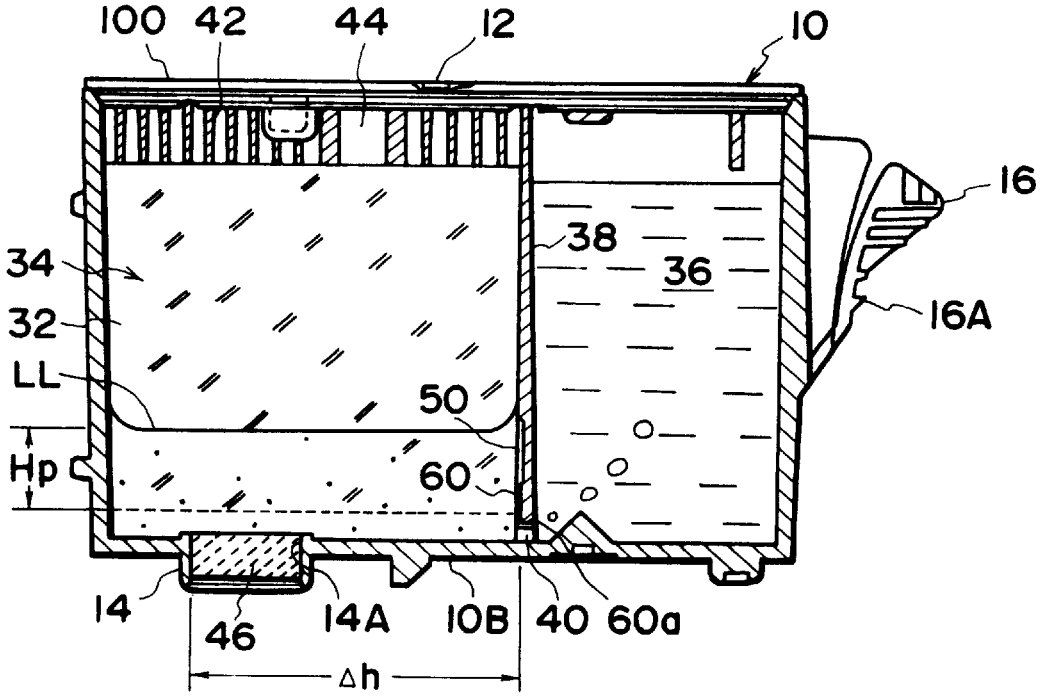
FIG. 9 is a section of an ink container compatible with-the liquid filling method in another embodiment of the present invention, and depicts the head difference Hp between the capillary force generating portion, and the gas-liquid interface LL within the absorbent member, and the pressure loss δh of the absorbent member, in a liquid container in which gas-liquid exchange is occurring.

FIG. 9 shows a state of the ink container 10, in which gas-liquid exchange has begun as ink consumption has started. Hp stands for the vertical distance between the gas-liquid interface LL within the absorbent member 32 as the negative pressure producing member, and the capillary force generating portion 60*a* within the second path 60 which comprises the capillary force generating portion 60*a*. In the ink container illustrated in FIG. 9, a piece of thermal compression absorbent material is used as the absorbent member 32; the absorbent member 32 is thermally compressed in advance, and then, is inserted into the negative pressure producing member holding chamber 34. As a result, the absorbent member 32 becomes substantially uniform in terms of compression ratio. Therefore, the gas-liquid interface LL in the absorbent member 32 becomes substantially level, except for the edge portions at which it slightly rises, FIG. 10 also shows a state of the ink container 10, in which gas-liquid exchange has begun as ink consumption has started. But, in the case of the ink container illustrated in FIG. 10, a piece of absorbent material which has not been compressed in advance is used as the absorbent member 32. In this case, a piece of absorbent material, the volume of which is substantially larger than the volume of the negative pressure producing member holding chamber 34 is compressed into the chamber 34, being reduced in volume by the compression, by 4–4.5 times. As a result, the absorbent member 32 is liable to become nonuniform in terms of compression ratio. Therefore, the gas-liquid interface LL in the absorbent member 34 becomes concave, with the edge portions rising much higher than the edge portions in FIG. 9. In this case, Hp is the vertical distance between the lowest point of the gas-liquid interface LL and the capillary force generating portion 60*a*.

Figure 10:
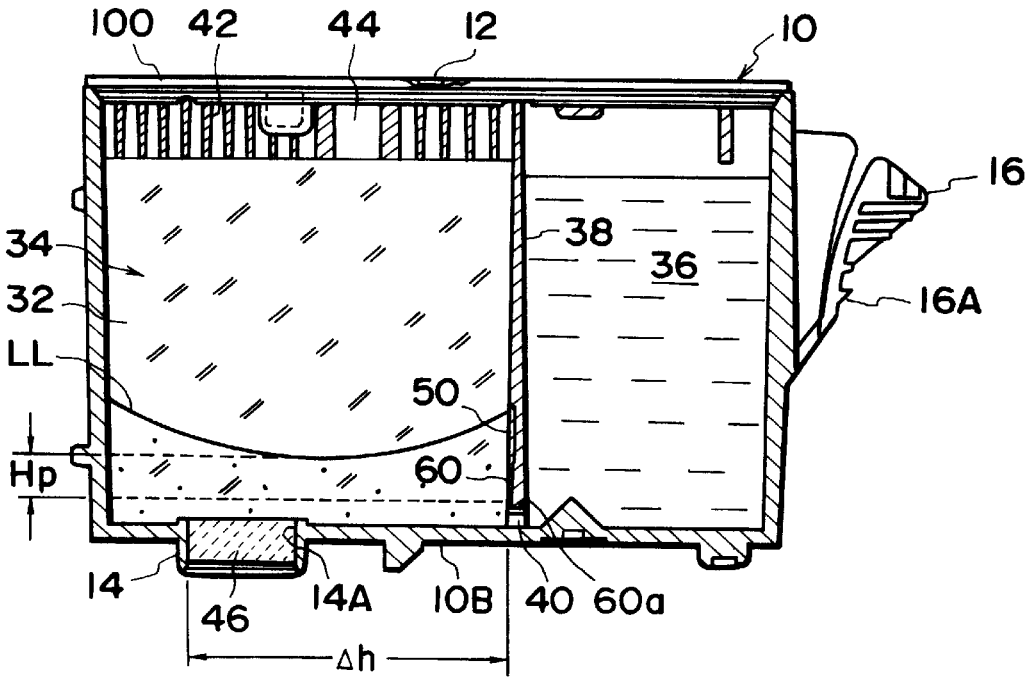
FIG. 10 is a section of an ink container compatible with the liquid filling method in another embodiment of the present invention, and depicts the head difference Hp between the capillary force generating portion, and the gas-liquid interface LL within the absorbent member, and the pressure loss δh of the absorbent member, in a liquid container in which gas-liquid exchange is occurring.

In FIGS. 9 and 10, δh stands for head loss in the absorbent member 32 as the negative pressure producing member, expressed in terms of length by dividing the pressure loss in the absorbent member 32 by the product of the ink density ρ and the gravitational acceleration g; when the pressure loss is δPe, $\delta h = \delta Pe/\rho g$. Since the pressure loss occurs in the absorbent member 32, the pressure loss is pressure loss which occurs between the edge of the absorbent member 32 and the edge of the ejection liquid delivery opening 14A as shown in the drawing. The pressure loss between the liquid holding chamber 36 and the communication port 40 is substantially zero. Therefore, δh is obtained simply by obtaining the pressure head difference between a point in the liquid holding chamber 36, and the edge of the liquid delivery opening 14A.

In the following description of the operational principle of an ink container in accordance with the present invention, the embodiment in which a part of the atmospheric air introduction path is constituted of the first path 50 and the second path 60 will be referred to. In terms of operational principle, the other embodiments, in which only the capillary force generating grooves are formed, are the same as the embodiment in which the atmospheric air introduction path 56 and the capillary force generating path 66 are formed.

As an ink jet type recording apparatus begins to be operated, ink is ejected from the ink jet head 22, which generates such force that works in the direction to such ink out of the ink container 10.

Figure 2:
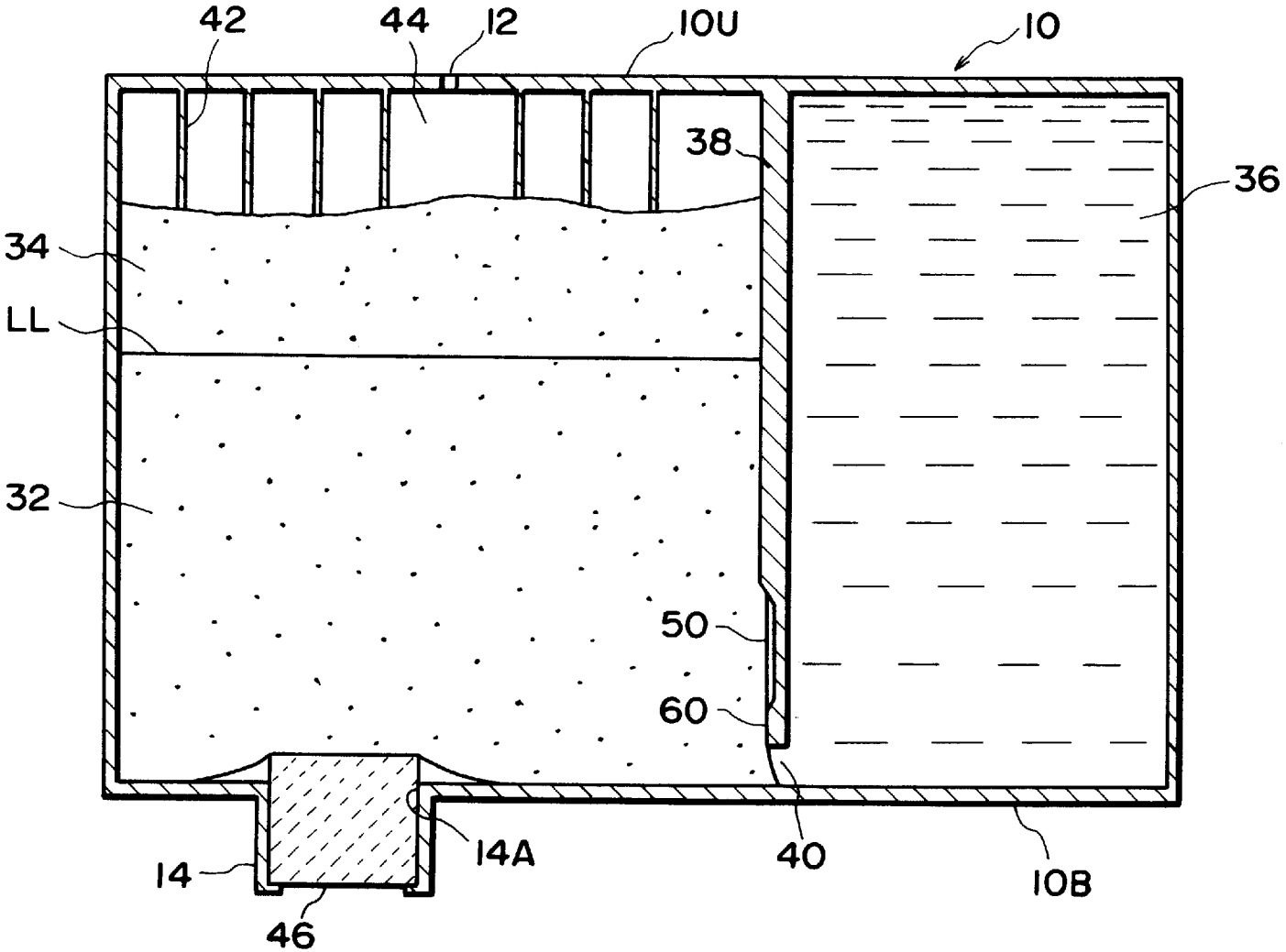
FIG. 2 is a vertical section of an ink container compatible with the liquid filling method in accordance with the present invention.

Then, the ink in the piece of negative pressure producing material, that is, the absorbent member 32, in the negative pressure producing member holding chamber 34, is consumed when the negative pressure producing material has been soaked with a sufficient amount of ink, and the top surface (gas-liquid interface) of the ink in the material descends (LL in FIG. 2). The magnitude of the negative pressure generated at this time is determined by the capillary force, at the gas-liquid interface LL, of the negative pressure producing material, and the height of the gas-liquid interface LL from the ejection outlet opening surface.

As the consumption of the ink continues, the gas-liquid interface LL first descends to the top end of the first path 50 of the atmospheric air introduction path, allowing the pressure in the second path 60 to increase. Then, as the pressure of the bottom portion of the liquid holding chamber 36 becomes lower than that of the second path 60, the atmospheric air is supplied into the liquid holding chamber 36 through the first and second paths 50 and 60. As a result, the pressure within the liquid holding chamber 36 increases by the amount equivalent to the amount of the introduced atmospheric air. Consequently, ink is supplied from the liquid holding chamber 36 into the absorbent member 32 through the communication port 40 to eliminate the difference between the increased pressure of the liquid holding chamber 36 and the pressure within the absorbent member 32 as the negative pressure producing member. In other words, gas is exchanged with liquid. As the gas-liquid exchange continues, the pressure in the bottom portion of the ink container increases by the amount equivalent to the amount of the ink supplied into the absorbent member 32, and eventually, the atmospheric air is prevented from being supplied into the liquid holding chamber 36.

During the consumption of the ink, the ink in the liquid holding chamber 36 is supplied into the negative pressure producing member holding chamber 34 because the aforementioned gas-liquid exchange continuously occurs. Thus, the magnitude of the negative pressure produced in the liquid holding chamber 36 is determined by the capillary force generated in the second path 60. In other words, the magnitude of the negative pressure produced in the liquid holding chamber 36 while the ink is consumed can be controlled by selecting the measurement of the second path 60.

Next, referring to FIG. 5, the operational principle of the ink container 10 in accordance with the present invention will be described in detail.

It is possible to theorize that the negative pressure producing member (absorbent member) 32 held in the negative pressure producing member holding chamber 34 has a large number of capillary tubes, and the meniscus force of these tubes generate negative pressure. Normally, in the ink container 10, the absorbent member 32 as the negative pressure producing member is soaked with a sufficient amount of ink, and therefore, it is assumed that the position of the head of the liquid in each theoretical capillary tube is sufficiently high.

As ink is consumed through the ink delivery opening 14A, the pressure at the bottom of the negative pressure producing member holding chamber 34 decreases, and the head position in each theoretical capillary tube descends. In other words, as ink is consumed, the position of the gas-liquid interface LL in the negative pressure producing member 32 descends as shown in FIG. 5, (A). In this state, the position of the head is not equal in all theoretical capillary tubes; the closer to the ink delivery opening 14A the theoretical capillary tube, the lower the position of the liquid head in the theoretical capillary tubes. This is due to the pressure loss that occurs in the absorbent member 32 as the negative pressure producing member.

Also in this state, the magnitude of the negative pressure generated in the ink container 10 is determined by the capillary force of the theoretical capillary tubes in the negative pressure producing member 32, and the pressure head at the ejection outlet opening surface of the ink jet head 22 is determined by the pressure head difference between the gas-liquid interface LL and the ejection outlet opening surface.

Figure 5:
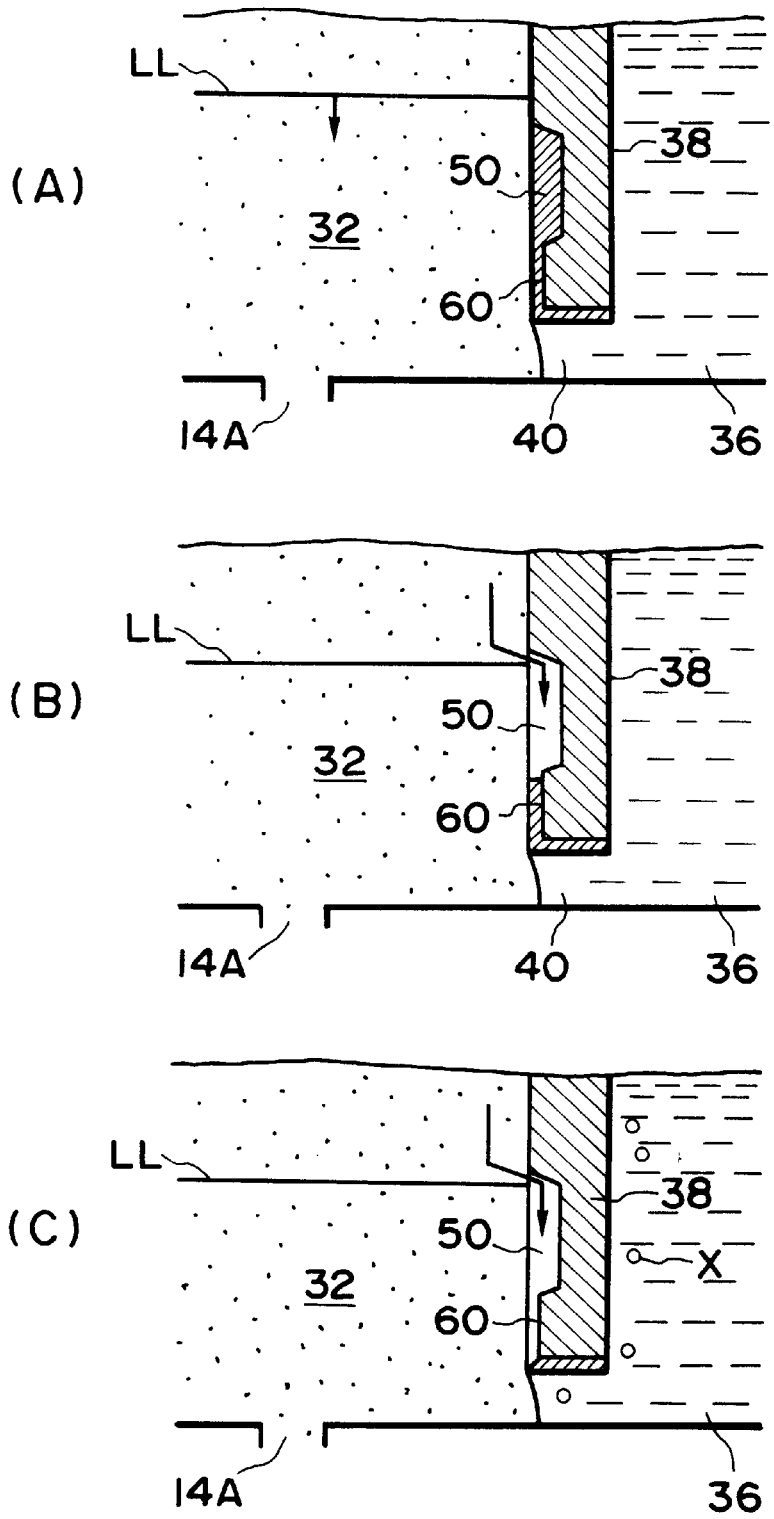
FIG. 5 is a schematic section of an ink container compatible with the ink liquid filling method in another embodiment of the present invention.

As ink is further consumed, the gas-liquid interface LL descends farther to the position shown in FIG. 5, (B). In this state, the top end of the first path 50 of the atmospheric air introduction path is slightly above the gas-liquid interface LL, allowing the atmospheric air to enter the first path 50. Since the ink container 10 is structured so that the capillary force generated in the second path 60 as the capillary force generating portion is rendered smaller than the capillary force generated by the theoretical capillary tubes of the absorbent member 32, the meniscus in the second path 60 is destroyed by the further consumption of ink. As a result, the atmospheric air X is introduced into the liquid holding chamber 36 through the second path 60 and the communication port 40, as shown in FIG. 5, (C). During this period, the gas-liquid interface LL does not descend farther.

As the atmospheric air X is introduced into the liquid holding chamber 36, the pressure in the liquid holding chamber 36 becomes higher than the pressure at the bottom of the negative pressure producing member holding chamber 34, and therefore, in order to eliminate the pressure difference, ink is supplied from the liquid holding chamber 36 to the negative pressure producing member holding chamber 34 by the amount equivalent to the amount of the pressure difference between the two chambers. Then, the pressure in the negative pressure producing member 32 becomes higher than the negative pressure produced by the second path 60, and therefore, ink flows into the second path 60, forming a meniscus. As a result, the introduction of the atmospheric air into the liquid holding chamber 36 is stopped.

As the ink is further consumed from this state, the meniscus in the second path 60 is destroyed again, without descent of the gas-liquid interface LL, and the atmospheric air is introduced into the liquid holding chamber 36, as described above. In other words, after the gas-liquid interface LL descends to the top end of the first path 50 of the atmospheric air introduction path, the destruction and regeneration of the meniscus in the second path 60 is repeated throughout the ink consumption, keeping substantially constant the negative pressure generated in the ink container 10, without the descent of the gas-liquid interface LL, that is, with the top end of the atmospheric air introduction path remaining in contact with the atmospheric air. The magnitude of this negative pressure is determined by the magnitude of the force necessary for the atmospheric air to destroy the meniscus in the second path 60; in other words, it is determined by the measurements of the second path 60 and the properties (surface tension, angle of contact, and density) of the ink being used.

Therefore, when the magnitude of the capillary force generated in the second path 60 as the capillary force generating portion is set to a value between the highest and lowest values of the magnitude of the capillary force which tends to vary depending on the color and the type of the ink or the like processing liquid being held in the liquid chamber, the same ink container structure can be used for all types of ink or the like to be ejected, without change.

The pressure at the ejection outlet opening surface of the ink jet head 22 is determined by the interaction among the capillary force generated in the second path 60, the pressure loss in the absorbent member 32, the difference in height between the bottom portion of the ink container and the ejection outlet opening surface, and the like.

At this time, the specifications, in terms of measurement, of the second paths 60, 61 and 64, which have been described above, and the second paths 63 and 64, which will be described later, will be described.

As described above, in order for ink to be supplied without interruption in response to the ink consumption, the negative pressure generated in the ink container 10 must be kept substantially constant. Further, after the ink container 10 has been inserted in the ink container holder 20 integral with the liquid ejection head, and the ink container holder 20 has been mounted on the carriage of an unillustrated ink jet type recording apparatus, that is, when the ink container 10 is on standby for printing, a predetermined pressure head difference has been established between the capillary force generating portion at the bottom of the ink container 10, and the ejection outlet opening surface. In this state, in order to prevent ink from leaking through the ejection outlet of the liquid ejecting head, the ink pressure at the ejection outlet opening surface in the ejection outlet must always remain below the atmospheric pressure.

Further, until the ink within the liquid holding chamber 36 is completely consumed, the vertical position of the gas-liquid interface LL must be kept steady; in other words, the vertical position of the meniscus at the gas-liquid interface LL within the absorbent member 32 must be kept steady in spite of the pressure loss which occurs as ink flows through absorbent member 32 while ink is consumed.

In order to satisfy the above conditions, the capillary force generated by the capillary force generating portion must satisfy the following formula:

$$H < h \leqq Hs - Hp - \delta h \quad (1)$$

In this formula, a symbol h stands for the magnitude, expressed in terms of length, of the capillary force generated by the capillary force generating portion, that is, a value obtained by dividing the magnitude of the capillary force generated by the capillary force generating portion, by the product of the density ρ of the liquid to be ejected, and the gravitational accelerating g; in other words, when the generated capillary force is δPc, $h=\delta Pc/\rho g$. A symbol H stands for the pressure head difference between the capillary force generating portion and the ejection outlet opening surface of a liquid ejection type head, and a symbol Hs stand for the magnitude, expressed in terms of length, of the capillary force generated by the negative pressure producing member, that is, a value obtained by dividing the magnitude of the capillary force generated by the negative pressure producing member, by the product of the density ρ of the liquid to be ejected, and the gravitational acceleration g: in other words, when the generated capillary force is δPs, $Hp=\delta Ps/\rho g$. A symbol Hp stands for the pressure head difference between the gas-liquid interface within the negative pressure producing member and the capillary force generating portion. A symbols δh stands for the magnitude, expressed in terms of length, of the pressure head loss between the communication port and the ejection liquid delivery opening, and is obtained by dividing the magnitude of the pressure lost in the negative pressure producing member, between the communication port and the ejection liquid delivery opening, by the product of the aforementioned density ρ, and the gravitational acceleration g; in other words, when the pressure loss is δPe, $\delta h=\delta Pe/\rho g$.

Generally speaking, the capillary force generated in a capillary tube can be expressed in terms of the length h, and when the capillary force generated in a capillary tube is δPc, this length h is obtained by the following formula:

$$h=L/S\times\Gamma/\rho g\times\cos\theta \quad (2)$$

In the formula, L stands for the peripheral length (cm) of the tube; S, the cross sectional area of the tube ($cm^2$); Γ, the surface tension of ink (dyn/cm); θ, angle of contact; ρ, the density ($g/cm^3$) and g stands for gravitational acceleration (980 $cm/s^2$).

Therefore, the measurements of the capillary force generating portion are required to satisfy the following formula obtained by substituting Formula (1) into Formula (2).

$$1/\cos\theta\times\rho g/\Gamma\times H<L/S\leqq 1/\cos\theta\times\rho g/\Gamma\times(Hs-Hp-\delta h) \quad (3)$$

In this formula, L stands for the peripheral length (cm) of the capillary force generating portion; S, the cross sectional area of the capillary force generating portion ($cm^2$); ρ, the density ink ($g/cm^3$); g, gravitational acceleration (980 $cm/s^2$), Γ, the surface tension of ink (dyn/cm); and θ stands for angle of contact.

While an ink jet type recording apparatus is in use, it is subjected to various physical forces, such as impact or acceleration caused by the scanning movement of the carriage, and ambient change such as temperature change or pressure change. Therefore, the ink pressure at the ejection outlet opening surface in the ejection outlet is desired to be rendered smaller by approximately −10 mm $H_2O$ than the atmospheric pressure, in view of the necessary for a safety margin.

In consideration of the above, the capillary force h expressed in terms of length is desired to satisfy the following formula:

$$H+hm<h\leqq Hs-Hp-\delta h.$$

Therefore, Formula (3) can be rearranged into:

$$1/\cos\theta\times\rho g/\Gamma\times(H+hm)<L/S\leqq 1/\cos\theta\times\rho g/\Gamma\times(Hs-Hp-h)$$

As for the measurements of the cross section of the second path 60, in order to generate sufficient capillary force, it is necessary that the width is in a range of 0.20–0.40 mm, and the depth is in the range of 0.20–0.40 mm. From the standpoint of keeping as small as possible the amount of invasion into the absorbent member 32 by the grooves, the width is desired to be less than the depth.

The only requirement regarding the cross sectional area of the first path 50 is that it is larger than the cross sectional area of the second path 60. As for the length of the second path 60, it should extend upward 2–10 mm from the top edge of the communication port 40. If it is too short, the contact by the absorbent member 32 does not stabilize, whereas if it is too long, the second path 60 becomes sensitive to the invasion by the absorbent member 32. Therefore, the length of the second path 60 is desired to be approximately 4 mm.

As described above, the vertical position of the top end of the first path 50 regulates the vertical position of the gas-liquid interface in the absorbent member 32, and therefore, the top end of the first path 50 must be positioned so that ink delivery is not interrupted, and the buffing function of the absorbent member 32 is not hindered. Desirably, the vertical position of the top end of the first path 50 is approximately 10–30 mm from the top edge of the communication port 40.

Up to this point, the description has been dedicated to the desirable liquid container compatible with the present invention. These containers comprised a partition wall which had an atmospheric air introduction path, and the atmospheric air introduction path led the atmospheric air from a negative pressure producing material chamber to a liquid chamber, and a part of the path constituted a capillary force generating portion. Next, the liquid filling method in accordance with the present invention will be described with reference to the drawings.

Embodiment 1

FIGS. 11–16 are schematic drawings which depict the processes, in the first embodiment, for filling liquid into a liquid container.

Figure 11:
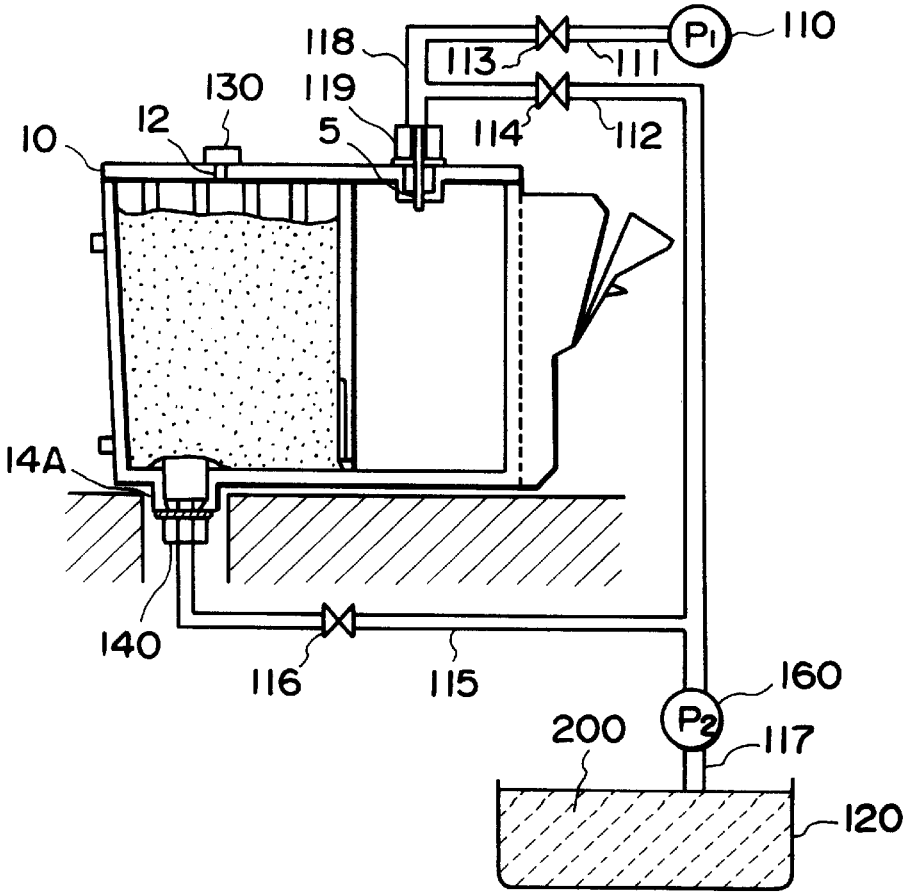
FIG. 11 is a sectional drawing which depicts a liquid filling apparatus and liquid filling method in accordance with the present invention.

First, referring to FIG. 11, a liquid container 10 is prepared, which comprises a partition wall, which has an atmospheric air introduction path for introducing the atmospheric air from the negative pressure producing member chamber into a liquid chamber. The portion of the atmospheric introduction path constitutes a capillary force generating portion.

Further, the liquid container 10 in this embodiment has an ink ejection port 5, which is located in the top portion of the second chamber, and through which liquid is injected. The "top surface portion" means the surface which faces the bottom surface of the liquid container in this embodiment.

Next, the liquid container is immovably placed in an ink injecting apparatus, with the communication port facing downward as shown in FIG. 11. Then, the ink delivery opening 14A and the air vent 12 are sealed, and the internal pressure of the ink chamber is reduced by evacuating the air within the liquid chamber. During this process, the angle of the ink container is the same as the angle which the ink container must assume to deliver ink (liquid) to the liquid ejecting head.

The ink ejecting apparatus in this embodiment, depicted in FIG. 11, comprises an ink reservoir 120 for holding ink 200 to be filed, and a vacuum pump 110 for reducing the internal pressure of the liquid container. It also comprises: tubes or pipes for connecting the reservoir 120 and the vacuum pump 200 to an ink container; valves placed midway along the passages; members for sealing an ink container; a locking device for firmly holding an ink container at the same angle as the angle at which the ink container is held when in use (communication port facing downward), and the like.

The ink reservoir 120 is open to the atmosphere, and an ink transfer tube 117 is inserted in the reservoir 120. The ink transfer tube 117 branches into two ink injection tubes 112 and 115, and is equipped with a pump 60 for transferring ink, so that ink can be transferred from the ink reservoir 120 to the ink ejection tubes 112 and 115 at a predetermined amount per unit of time. Both ink injection tubes 112 and 115 are equipped with valves 114 and 116, respectively, at their middle sections, and their ink container side ends are fitted with coupling members 119 and 140, respectively. Ink can be flowed into the ink injecting tube 112 by opening the valve 114 while keeping the value 116 closed, and into the ink injecting tube 115 by opening the valve 116 while keeping the valve 114 closed. The amount of ink flowed into each ink injection tube can be varied by controlling the revolution of the motor for the pump.

The vacuum pump 110 is connected to a vacuum tube 111 for reducing the internal pressure of a liquid container. The ink container side of the vacuum tube 111 turns into a tube 118, the middle section of which is connected to the ink injection tube 112, and the ink container side of which is fitted with a coupling member (sealing member) 119. The vacuum tube 111 is equipped with a valve 113, which is located midway between the point where the vacuum tube turns into a tube 118, and the vacuum pump 110.

In this embodiment, an ink container is placed in a sealed state by sealing the air vent 12 with a sealing member 130, coupling the ink delivery port 14 with the coupling member 140, closing the valve 116, and coupling the ink injection port 5 with the coupling member 119. The internal pressure of the sealed ink container is reduced by operating the vacuum pump 110 after closing the valve 114 and opening the valve 113. The internal pressure of an ink container is reduced to approximately 0.01–0.05 in absolute pressure.

Figure 12:
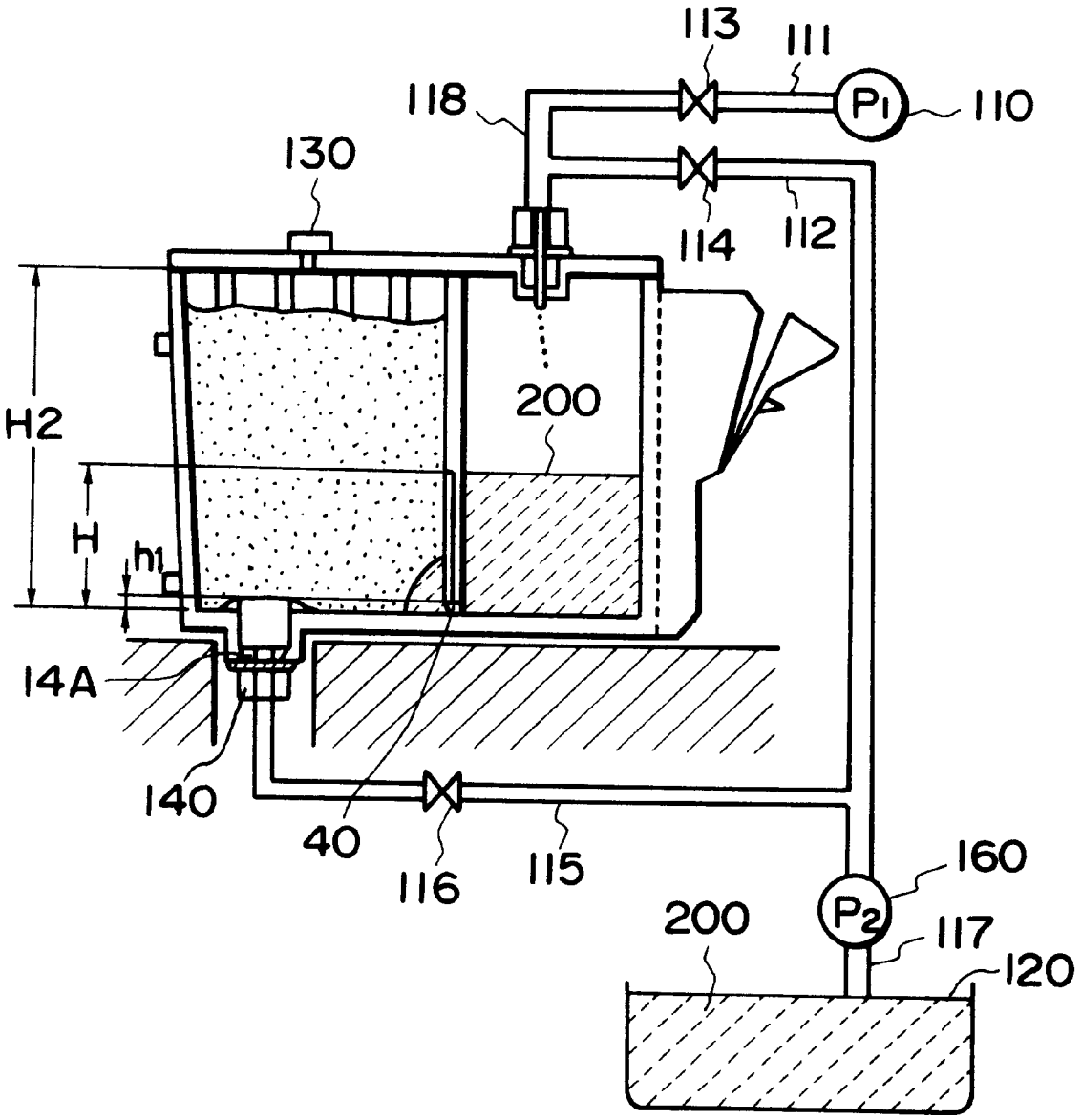
FIG. 12 is a sectional drawing which depicts a liquid filling apparatus, and a liquid filling method, in accordance with the present invention.
Figure 13:
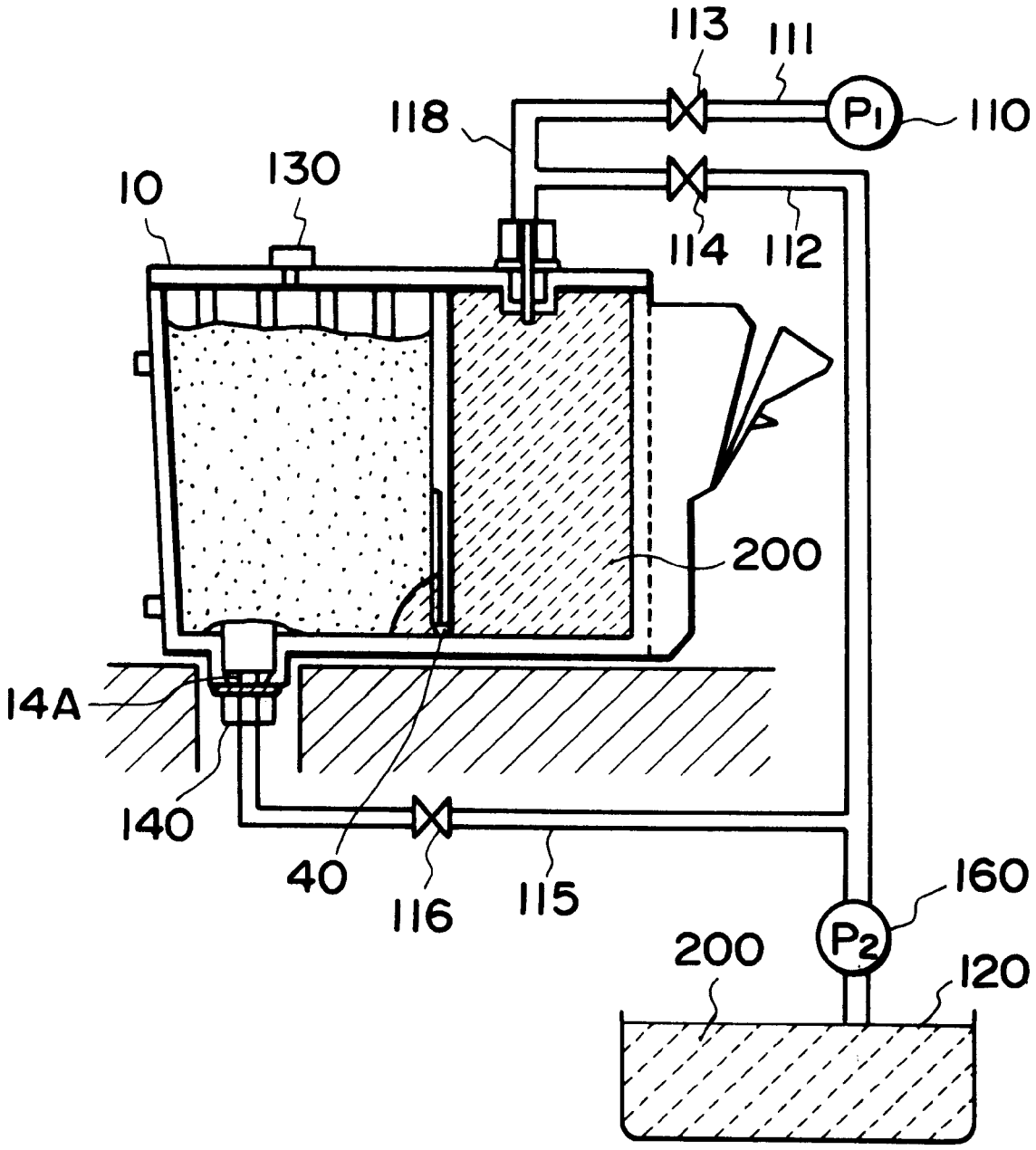
FIG. 13 is a sectional drawing which depicts a liquid filling apparatus, and a liquid filling method, in accordance with the present invention.

After the pressure reduction, ink is injected into the second chamber through the ink injection port 5, as shown in FIGS. 12 and 13. In this embodiment, ink can be injected into the second chamber through the ink injection port 5 at a predetermined high ink filling speed by closing the valve 113, stopping the vacuum pump 110, operating the pump 160, and opening the valve 114.

Ink is first injected into the second chamber. Then, ink is also injected into the first chamber through the communication port 40 while ink is injected into the second chamber, because during this ink filling process, the internal pressure of the ink container is reduced throughout the entire internal space of the ink container.

However, when the speed at which liquid is filled into the second chamber is first, the amount of the ink filled into the first chamber by the time the second chamber is completely filled with liquid is very small. In such a case, the ink having filled into the negative pressure producing member permeates mainly through the surface portion of the negative pressure producing member, forming a gas-liquid interface. In other words, during this ink filling process, only limited regions of the negative pressure producing member, that is, the adjacencies of the communication port, and the surface portions, are filled with ink. Therefore, it is assured that the second chamber is filled completely, that is, without leaving any of its regions unfilled with ink, before the internal pressure-reduced condition of the first chamber significantly changes from the condition at the end of the internal pressure reducing process depicted in FIG. 11.

On the other hand, when the speed at which liquid is filled into the second chamber is slower, more ink is filled into the first chamber by the amount proportional to the reduced amount of speed; the amount of ink filled into the negative pressure producing member increases. As a result, after forming the gas-liquid interface, ink permeates farther into the negative pressure producing member, allowing the internal pressure to rise. In other words, the internal pressure of the entire ink container is allowed to rise, leaving the substantial region of the second chamber unfilled with ink. Consequently, the amount of ink in the second chamber does not increase beyond a certain level, and instead, ink is filled into the first chamber.

If ink is filled into the first chamber by an amount large enough to fill the negative pressure producing member, up to the adjacencies of the top end of the atmospheric air introduction path, the ink having been filled into the first chamber permeates into the region with low flow resistance in the negative pressure producing member, leaving the region with high flow resistance in the negative pressure producing member unfilled with ink. This sometimes makes it difficult to uniformly fill the negative pressure producing member with ink, which in turn makes it difficult for the ink to be stably delivered from a liquid container to a liquid ejecting head portion.

Thus, in order to satisfactorily fill a liquid container with liquid, that is, in order to leave as little air as possible in the second chamber, the inventors of the present invention paid attention to the relationship between the speed at which liquid is filled, and the speed at which the negative pressure producing member absorbs ink upward, and set up the ink filling speed at such a speed the ink is filled through the ink injection port, substantially faster than the speed at which ink permeates substantially deep into the negative pressure producing member.

More specifically, the ink injecting speed has only to be such a speed that exceeds the speed at which the capillary force of the negative pressure producing member absorbs ink upward against the flow resistance. The rests which were conducted by the inventors of the present invention confirmed that when the negative pressure producing member formed of compressed polyurethane foam with an average pore size of 90–200 pore/inch was used; surface tension of ink Γ was 30–50 dyn/cm; ink viscosity was approximately 2 cps; the length hl and cross sectional area of the communication port illustration in FIG. 12 were 2 mm and 11–15 $mm^2$, respectively; and the bottom surface area and height of the second chamber were 4.5–10 $mm^2$ and 51.5 mm, respectively, the height to which ink was absorbed in the region adjacent to the atmospheric air introduction path, in the negative pressure producing member, could be kept below the height H of the atmospheric air introduction path as long as the aforementioned ink injection speed was kept at a speed no less than 15 cc/sec and no more than 25 cc/sec.

The reason for setting an upper limit to the ink filling speed is that if the injection speed is excessive, it is possible that the negative pressure producing member held in the negative pressure producing member chamber may be shifted within the chamber.

Figure 14:
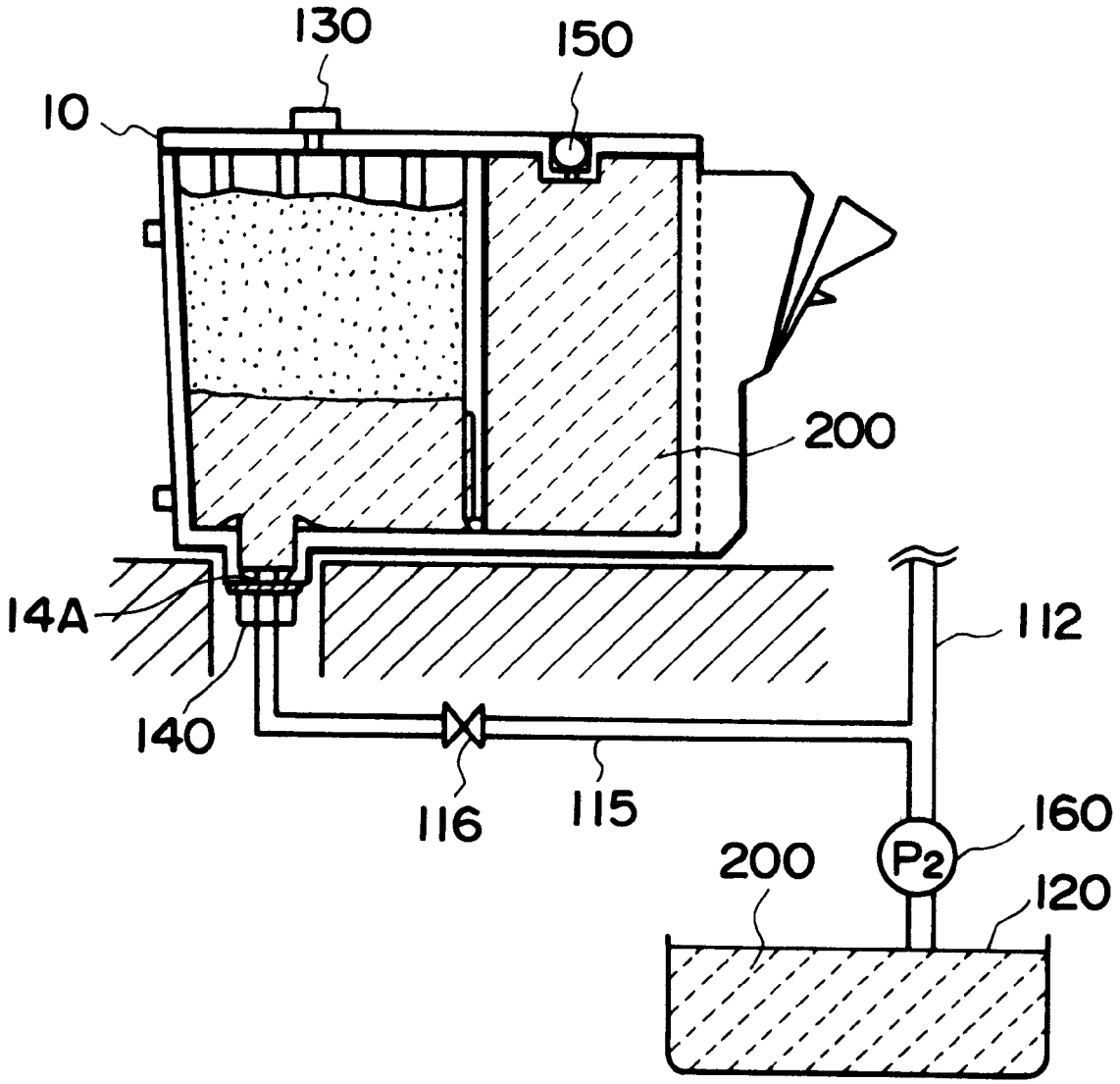
FIG. 14 is a sectional drawing which depicts a liquid filling apparatus, and a liquid filling method, in accordance with the present invention.

Referring to FIG. 14, after the second chamber is filled with ink, the ink injection port 5 is sealed, and then, ink is fitted into the first chamber through the ink delivery opening 14A. More specifically, in this embodiment, first, the valve 114 is closed, and the coupling portion is removed from the ink injection port. Then, the ink injection port is sealed with a ball 150 formed of SUS or the same material as the material for the liquid container. Therefore, the ink delivery speed of the pump 160 is adjusted. Finally, the valve 116 is opened to start filling ink into the first chamber through the ink delivery opening 14A.

Figure 15:
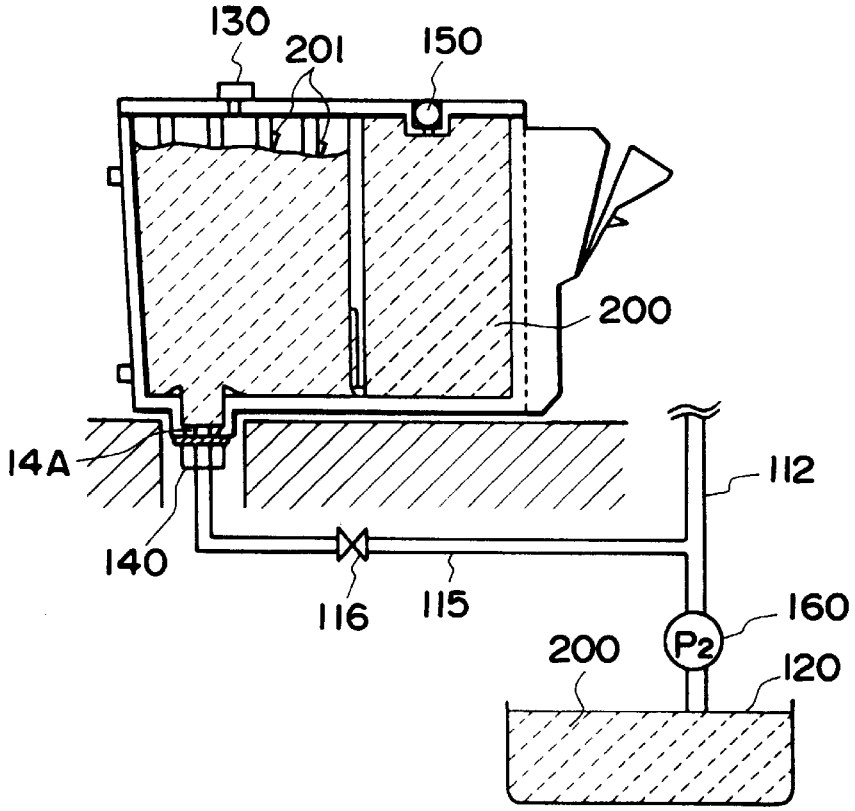
FIG. 15 is a sectional drawing which depicts a liquid filling apparatus, and a liquid filling method, in accordance with the present invention.

Filling ink into the first chamber through the ink delivery opening 14A assures, in conjunction with the ink 200 filled into the negative pressure producing member in the first chamber while ink is filled through the second chamber side as shown in FIGS. 12 and 13, that the ink delivery route is desirably filled with ink, and also that the negative pressure producing member is virtually evenly filled with ink, that is, without leaving any region in the negative pressure producing member unwetted with ink, as shown in FIGS. 14 and 15.

It is desirable that for this process, the ink filling speed is slightly reduced, compared to the aforementioned speed at which ink is injected into the second chamber, by changing the ink delivery speed of the pump 160, because if the ink filling speed is too fast, ink is liable to be filled through easily passable regions, for example, the gap between the negative pressure producing member and the wall of the first chamber which is holding the negative pressure producing member. According to this embodiment, a speed of approximately 15 cc/sec was desirable.

After liquid is filled into the negative pressure producing member in the first chamber as shown in FIG. 15, the ink delivery opening is sealed as shown in FIG. 16, and then, the air vent is opened to introduce air into the first chamber from outside. As a result, the state of the liquid container in terms of internal pressure is restored from the pressure-reduced state to the normal pressure state. More specifically, in this embodiment, first, the valve 116 is closed, and then, the pump 160 is stopped. Thereafter, the sealing member 130 is removed from the air vent to allow the air to enter the first chamber.

Restoring the internal pressure of the liquid container from the reduced state to the normal state by unsealing the air vent as in this embodiment can cause the s-called free ink, that is, the ink which oozes out of the negative pressure producing member while ink is filled into the negative pressure producing member, to be forced back into the negative pressure producing member to be held therein, if free ink happens to be present.

Further, in this embodiment, a predetermined amount of liquid can be removed through the ink delivery opening 14A by operating the pump 160 in reverse, to turn a region 32*a*, adjacent to the buffer chamber, of the negative pressure producing member, into such a region that is not holding ink, and a region 32*b*, that is, the other region of the negative pressure producing member, into such a region that is holding ink in a desirable manner, so that the gas-liquid interface 220 becomes substantially horizontal as shown in FIG. 16. This process is carried out as necessary, for example, when it must be assured that a region which is not holding ink is secured in the top portion of the negative pressure producing member, for example, the region adjacent to the buffer chamber.

As is evident from the above description, not only does the liquid filling method in accordance with the present invention reduce, by increasing the speed at which liquid is filled into the second chamber, the time necessary to inject liquid into a container, but also assures that ink is desirably filled into the second chamber. Therefore, it greatly improves productivity. Regarding the size of a liquid container to which the present invention is applicable, liquid containers with a second chamber capacity of no less than 10 cc are preferable; it does not means that the present invention is not applicable to containers with a second chamber capacity of no more than 10 cc.

Regarding the ingredients of the ink to be filled, those inks which contain surfactant, for example, acetynol, by no more than 1%, or those inks which do not contain any surfactant, are low in permeability into the negative pressure producing member, and are therefore difficult to fill into the negative pressure producing member at a high speed. However, the liquid filling method in accordance with the present invention makes it possible to fill even those inks into a liquid container at a high speed, by filling liquid into the liquid container after reducing the internal pressure of the liquid container.

Embodiment 2

In the preceding embodiment, the internal space of a liquid container is opened to the atmospheric air after a liquid container is completely filled with ink. However, the internal space of a liquid container may be opened to the atmospheric air immediately before the negative pressure producing member chamber is completely filled with ink. The reason for this alternative is that opening the air vent immediately before the negative pressure producing member chamber is completely filled with ink can mitigate the effects of the sudden change which occurs to the state of the liquid container; for example, it can prevent air from being pulled into the second chamber by the sudden contraction of the certain regions of the internal space of the second chamber, which has not been filled with ink.

Carrying out the above described process can also prevent the ink 201 from adhering to the walls of the air buffer chamber as shown in FIG. 15, and therefore, can afford more latitude in designing the shape or structure of the air buffer chamber.

Further, the process that characterizes this embodiment may be carried out in combination with the process of discharging a predetermined amount of liquid from the ink delivery opening, which was described in the first embodiment.

Embodiment 3

Figure 17:
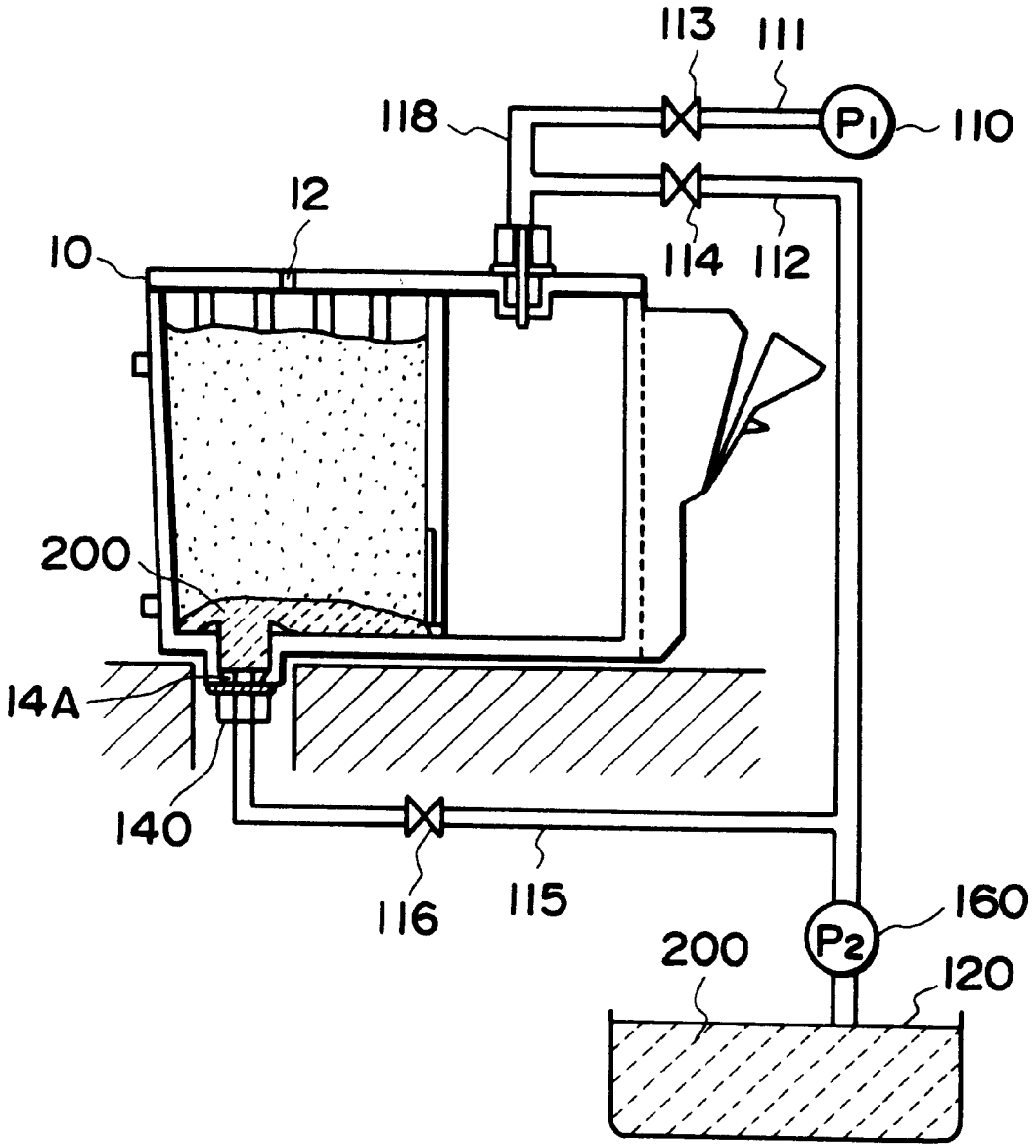
FIG. 17 is a sectional drawing which depicts a liquid filling apparatus, and a liquid filling method, in accordance with the present invention.

In the preceding embodiments, ink is filled through the ink delivery opening of the first chamber after the completion of the ink filling into the second chamber. However, a small amount of ink may be filled through the ink delivery opening 14A of the first chamber before liquid is filled into the second chamber as shown in FIG. 17.

In this embodiment, an arrangement is made to fill the small amount of ink present between the valve 116 of the ink transfer tube 115, and the coupling member 140, into a liquid container at the same time as the internal pressure of the liquid container begins to be reduced after the container is firmly held.

Filling a minute amount of ink into the first chamber before filling liquid into the second chamber as described above can assure that the ink delivery route is desirably filled during the process of filling into the first chamber. It is desirable that the amount of the ink to be filled during this process is just enough to wet the bottom portion of the negative pressure producing member, that is, the portion adjacent to the ink delivery opening and the communication port.

This process of filling a minute amount of ink into the first chamber may be carried out at the same time as, or after, the pressure reducing process.

Figure 18:
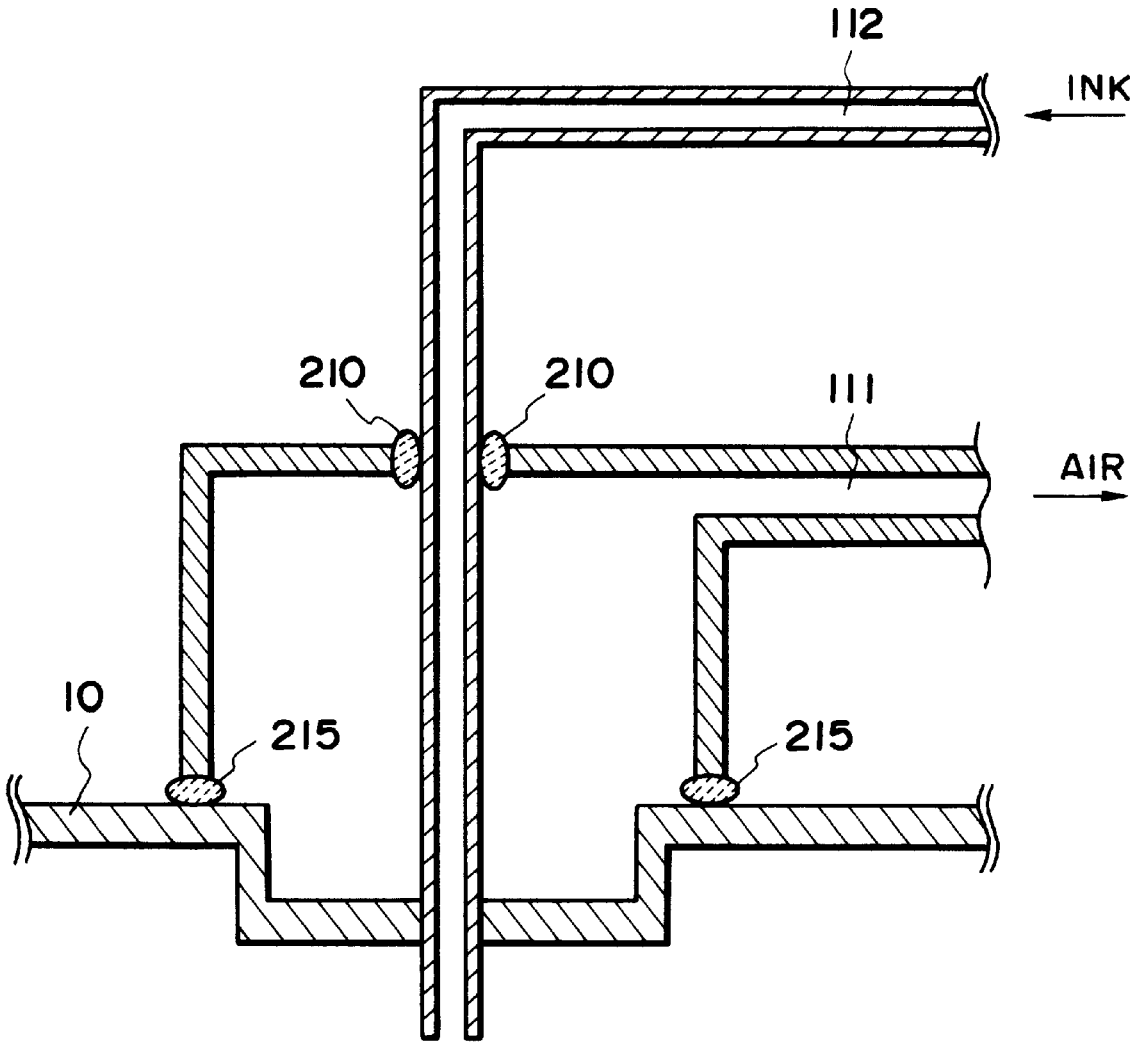
FIG. 18 is a schematic section of the essential portion of the liquid filling apparatus compatible with the liquid filling method in another embodiment of the present invention.

Needless to say, the choice of the liquid injecting apparatus compatible with the liquid filling method in accordance with the present invention described in the preceding embodiments, is not limited to the liquid injecting apparatus described in the preceding embodiments. For example, instead of using the tube 118 integral with the ink injection tube and the vacuum tube, the structure depicted in FIG. 18 may be used, in which the gaps between the vacuum tube 111 and the liquid container 10 are sealed with sealing members 215, and an ink injection tube 112 is put through a hole cut in the wall of the expanded portion of the vacuum tube 111, the gap between the edge of the hole and the vacuum tube 111 being sealed with sealing members 120. Further, as additional opening, which is different from the ink injection opening, may be cut in the wall of the second chamber, so that one opening is connected to the vacuum tube, and the other is connected to the ink injecting tube. The last arrangement can prevent ink from detouring into the vacuum pump through the vacuum tube, and deteriorating the performance of the vacuum pump, during the pressure reduction.

In the preceding embodiments, ink is referred to as the liquid to be filled. However, needless to say, the present invention is also compatible with liquid other than ink, for example, processing liquid for improving image quality, as long as the liquid is such liquid that is ejectable from a liquid ejecting head to which a liquid container is connected.

Further, in the embodiments described above, the liquid filling method in accordance with the present invention was described as a method for injecting liquid into a liquid container during one of the manufacturing processes for a liquid container. However, the liquid filling method in accordance with the present invention is also usable, with desirable results, for refilling a liquid container after or before the container is completely depleted of liquid. In other words, the liquid filling method in accordance with the present invention is such a liquid method that is usable for not only initially filling a liquid container, but also refilling a liquid container after a liquid container is put to use.

As described above, according to the liquid filling method in accordance with the present invention, not only can the time necessary for injecting liquid into a liquid container be reduced by increasing the speed at which liquid is filled into the second liquid chamber, but also assures that ink is accurately filled into the second chamber. In other words, the liquid filling method in accordance with the present invention is a liquid filling method with high injection accuracy and high productibity.

Further, according to an aspect of the ink filling method in accordance with the present invention, liquid is filled into a liquid container after the pressure of the entire internal space of the liquid container is reduced, and therefore, even liquid such as ink which is slow in permeating a negative pressure producing member can be filled at a high speed.

Further, according to another aspect of the present invention, the liquid in the first chamber is discharged by a predetermined amount to create a region rid of liquid, in the negative pressure producing member, adjacent to the buffer chamber, after the first chamber is completely filled. This region rid of liquid possesses a proper degree of absorbency for cushioning the liquid container against ambience changes or the like.

According to another aspect of the present invention, before starting to fill liquid into the second chamber, liquid is filled into the adjacencies of the communication port through the liquid delivery port of the first chamber, assuring that the portion of the negative pressure producing member, which becomes an ink delivery route while a liquid container is in use, is desirably filled with liquid. Therefore, even if container size is large, liquid is reliably delivered.

While the invention has been described with reference to the structures disclosed herein, it is not confined to the details set forth and this application is intended to cover such modifications or changes as may come within the purposes of the improvements or the scope of the following claims.

What is claimed is:

1. A method of supplying liquid into a liquid container, which includes a first chamber, provided with a liquid supply portion for supplying liquid out to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the method comprising:

a pressure reducing step of reducing a pressure of an entirety of the container, while the liquid container is hermetically sealed;

a first liquid supplying step of supplying the liquid into the second chamber, and completing the liquid supply before a portion adjacent to the gas-liquid exchange promoting structure in the first chamber is supplied with the liquid, in a reduced pressure state provided by the pressure reducing step, with the container taking the same orientation as when the liquid is supplied to the liquid ejecting head;

a second liquid supplying step of supplying the liquid into the first chamber through the liquid supply portion, after the first liquid supplying step into the second chamber; and a releasing step of releasing the hermetically sealed state of the first chamber after the second liquid supplying step into the first chamber.

2. A method according to claim 1, wherein a small quantity of the liquid is supplied to the communicating portion through the liquid supply portion of the first chamber before the first liquid supplying step.

3. A method according to claim 1, wherein the releasing step is carried out immediately before the completion of the second liquid supplying step.

4. A method according to claim 1, wherein a liquid injection speed is not lower than 15 cc/sec and not higher than 25 cc/sec in the first liquid supplying step.

5. A method according to claim 1, wherein the air vent is disposed at a top surface of the liquid container, and the ink container is provided with an air buffer chamber, at a lower portion of the air vent, for fluid communication with the ambient air through the air vent.

6. A method according to claim 1, wherein capillary force produced by a capillary force generating portion of the liquid container satisfies:

$$H<h\leqq Hs-Hp-\delta h$$

wherein h is capillary force in a dimension of length, provided by dividing the capillary force generated by the capillary force generating portion by density π of the liquid to be ejected and by gravitational acceleration g;

h=δPc/ρg, wherein δPc is the generated capillary force, H is a potential head difference between the capillary force generating portion and a liquid ejecting head surface having the ejection outlets; Hs is capillary force of the negative pressure producing member in a dimension of length, provided by dividing the capillary force by the densitρr& of the liquid to be ejected and by the gravitational acceleration g; Hs=δPρr&g, wherein δPs is the capillary force, Hp is a potential head difference between a gas-liquid interface in the negative pressure producing member and the capillary force generating portion, δh is the capillary force in the dimension of length, provided by dividing a pressure loss in the negative pressure producing member between the fluid communication path and the liquid supply opening by the densρ ρ of the liquid to be ejected, and by the gravitational acceleration g, that is, δh=δPe/ρg where δPe is the generated capillary force.

7. A method according to claim 1, wherein a volume of the second chamber of the liquid container is not less than 10 cc.

8. A method of supplying liquid into a liquid container, which includes a first chamber, provided with a liquid supply portion for supplying liquid out to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the method comprising:

a pressure reducing step of reducing a pressure of an entirety of the container, while the liquid container is hermetically sealed;

first liquid supplying step of supplying the liquid into the second chamber, and completing the liquid supply before a portion adjacent to the gas-liquid exchange promoting structure in the first chamber is supplied with the liquid, in a reduced pressure state provided by the pressure reducing step, with the container taking the same orientation as when the liquid supplied to the liquid ejecting head;

a second liquid supplying step of supplying the liquid into the first chamber through the liquid supply portion, after the first liquid supplying step into the second chamber; and a liquid discharging step of discharging a predetermined quantity of the liquid from the first chamber through the liquid supply portion after the second liquid supplying step.

9. An apparatus for supplying liquid into a liquid container, which includes a first chamber, provided with a liquid supply portion for supplying liquid out to a liquid ejection head and an air vent for fluid communication with ambient air, for accommodating therein a negative pressure producing member; a second chamber forming a substantially sealed space except for a communication part with the first chamber, wherein the liquid supply portion is disposed at a bottom side; and a gas-liquid exchange promoting structure, provided in the first chamber, for introducing the ambient air into the second chamber to permit discharging of the liquid, the apparatus comprising:

sealing means for sealing the liquid container;

pressure reducing means for reducing a pressure of an entirety of the container, while the liquid container is hermetically sealed;

first liquid supplying means for supplying the liquid into the second chamber, and for completing the liquid supply before a portion adjacent to the gas-liquid exchange promoting structure in the first chamber is supplied with the liquid, in a reduced pressure sate provided by said pressure reducing means, with the container taking the same orientation as when the liquid is supplied to the liquid ejecting head;

second liquid supplying means for supplying the liquid into the first chamber through the liquid supply portion, after the supply of liquid into the second chamber by said first liquid supplying means; and releasing means for releasing the hermetically sealed state of the first chamber after the supply of liquid into the first chamber by said second liquid supplying means.

10. An apparatus according to claim 9, wherein the pressure reducing means is connected to the first liquid supplying means.

* * * * *

UNITED STATES PATENT AND TRADEMARK OFFICE

CERTIFICATE OF CORRECTION

PATENT NO. : 6,058,984

DATED : May 9, 2000

INVENTOR(S) : Osamu Sato

It is certified that error appears in the above-identified patent and that said Letters Patent is hereby corrected as shown below:

Column 1

Line 9, change "particularly," to --particular,--.

Column 2

Line 34, change "e" to --be--.

Column 3

Line 50, change "method" to --a method--.

Column 4

Line 67, change "method" to --methods--.

Column 5

Line 13, change "use," to --used,--; and
line 22, change "graster," to --greater,--.

UNITED STATES PATENT AND TRADEMARK OFFICE

CERTIFICATE OF CORRECTION

PATENT NO. : 6,058,984

DATED : May 9, 2000

INVENTOR(S) : Osamu Sato

It is certified that error appears in the above-identified patent and that said Letters Patent is hereby corrected as shown below:

Column 16

Line 57, change "symbols" to --symbol--.

Column 21

Line 8, change "s-called" to --so-called--; and
line 37, change "means" to --mean--.

Column 24

Line 27, change "density π" to --density ρ--; and
line 45, change "densρ ρ" to --density ρ--.

Column 26

Line 10, change "sate" to --state--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*